US009006599B2

(12) United States Patent
Adams et al.

(10) Patent No.: US 9,006,599 B2
(45) Date of Patent: Apr. 14, 2015

(54) METHOD AND DEVICE FOR SORTING PRODUCTS

(75) Inventors: Dirk Adams, Tongeren (BE); Pieter Op De Beeck, Kortenaken (BE)

(73) Assignee: Visys, Hasselt (BE)

( * ) Notice: Subject to any disclaimer, the term of this patent is extended or adjusted under 35 U.S.C. 154(b) by 1033 days.

(21) Appl. No.: 12/518,239

(22) PCT Filed: Dec. 10, 2007

(86) PCT No.: PCT/IB2007/055414

§ 371 (c)(1),
(2), (4) Date: Dec. 11, 2009

(87) PCT Pub. No.: WO2008/142496

PCT Pub. Date: Nov. 27, 2008

(65) Prior Publication Data

US 2010/0096299 A1 Apr. 22, 2010

(30) Foreign Application Priority Data

Dec. 8, 2006 (BE) ..... 2006/0606

(51) Int. Cl.
*B07C 5/00* (2006.01)
*B07C 5/342* (2006.01)

(52) U.S. Cl.
CPC ..... *B07C 5/342* (2013.01)

(58) Field of Classification Search
USPC ..... 700/126; 209/577
IPC ..... B07C 5/342
See application file for complete search history.

(56) References Cited

U.S. PATENT DOCUMENTS 4,448,526 A * 5/1984 Miyazawa ..... 356/237.1
4,532,723 A * 8/1985 Kellie et al. ..... 356/73
4,634,281 A * 1/1987 Eikmeyer ..... 356/431

(Continued)

FOREIGN PATENT DOCUMENTS

DE 102004021689 A1 11/2005
EP 0443769 A2 2/1991

(Continued)

OTHER PUBLICATIONS

Carver, G.E., et al., "A fiber grating based distributing light source." Photonic Sensing Technologies, ed. Michael A. Marcus. Proc. of SPIE vol. 6371, 63710H (2006).

(Continued)

*Primary Examiner* — Stefanos Karmis
*Assistant Examiner* — Michael E Butler
(74) *Attorney, Agent, or Firm* — The Marbury Law Group, PLLC

(57) ABSTRACT

The invention concerns a method and apparatus for sorting a stream of products by scanning this stream of products with a bundle of concentrated light and analyzing the light originating from the scanned products and a background element, wherein this background element is chosen such that the corresponding detected light signal differs from the light signals originating from the products to be sorted in at least one parameter and wherein one or more control signals are generated by shifting the background level of the observed light signals to a signal level chosen such that, in the thus obtained signal, the signal level of the signal of a scanned product to be accepted distinguishes itself from the signal level of the signal of a scanned product to be rejected.

48 Claims, 14 Drawing Sheets

(56) References Cited

U.S. PATENT DOCUMENTS

| | | | | |
|---|---|---|---|---|
| 4,634,881 | A | 1/1987 | Billion | |
| 4,697,709 | A * | 10/1987 | Codding | 209/549 |
| 4,723,659 | A * | 2/1988 | Billion | 209/576 |
| 5,128,550 | A * | 7/1992 | Erbeck | 250/559.01 |
| 5,335,791 | A * | 8/1994 | Eason | 209/588 |
| 5,352,888 | A * | 10/1994 | Childress | 250/223 R |
| 5,398,818 | A * | 3/1995 | McGarvey | 209/580 |
| 5,409,119 | A * | 4/1995 | Rao Datari | 209/580 |
| 5,440,648 | A * | 8/1995 | Roberts et al. | 382/141 |
| 5,642,198 | A * | 6/1997 | Long | 356/430 |
| 5,884,775 | A * | 3/1999 | Campbell | 209/581 |
| 6,169,840 | B1 * | 1/2001 | Lemelson | 386/201 |
| 6,252,189 | B1 * | 6/2001 | Campbell | 209/581 |
| 6,271,520 | B1 | 8/2001 | Tao et al. | |
| 6,366,357 | B1 * | 4/2002 | Svetkoff et al. | 356/602 |
| 6,734,383 | B1 * | 5/2004 | Calcoen et al. | 209/577 |
| 6,864,970 | B1 * | 3/2005 | Ruymen et al. | 356/237.1 |
| 8,161,818 | B2 * | 4/2012 | Elze et al. | 73/627 |
| 8,282,589 | B2 * | 10/2012 | Moenning et al. | 602/18 |
| 8,609,422 | B2 * | 12/2013 | Durack et al. | 436/63 |
| 8,636,148 | B2 * | 1/2014 | Harding et al. | 209/11 |
| 8,642,910 | B2 * | 2/2014 | Pellenc et al. | 209/576 |
| 2003/0034282 | A1 * | 2/2003 | Safai | 209/582 |
| 2004/0179207 | A1 * | 9/2004 | Svetkoff et al. | 356/612 |
| 2006/0182334 | A1 * | 8/2006 | Akimoto | 382/145 |
| 2007/0008538 | A1 * | 1/2007 | Kiraly | 356/430 |
| 2007/0030476 | A1 * | 2/2007 | Adams et al. | 356/237.1 |
| 2008/0316476 | A1 * | 12/2008 | Rudert | 356/239.1 |
| 2009/0238449 | A1 * | 9/2009 | Zhang et al. | 382/165 |
| 2012/0303157 | A1 * | 11/2012 | Chung | 700/223 |
| 2013/0056398 | A1 * | 3/2013 | Adams et al. | 209/587 |

FOREIGN PATENT DOCUMENTS

| | | | |
|---|---|---|---|
| EP | 0719598 | A2 | 7/1996 |
| EP | 1012582 | | 8/2004 |
| EP | 1724030 | A2 | 11/2006 |
| EP | 2468426 | A1 | 6/2012 |
| EP | 2671651 | A1 | 12/2013 |
| WO | 01/00333 | A1 | 1/2001 |
| WO | 2007/062219 | A1 | 5/2007 |
| WO | 2008/142496 | | 11/2008 |

OTHER PUBLICATIONS

International Preliminary Report on Patentability for International Application No. PCT/IB2007/055414 dated Jun. 10, 2009.

International Search Report for International Application No. PCT/IB2007/0055414 dated Nov. 21, 2008.

Written Opinion of the International Searching Authority from the European Patent Office in International Application No. PCT/IB2007/055414.

* cited by examiner

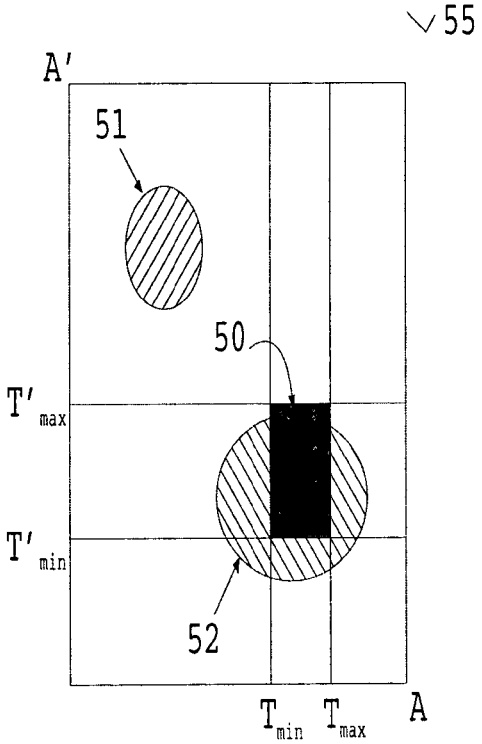
Figure 7a
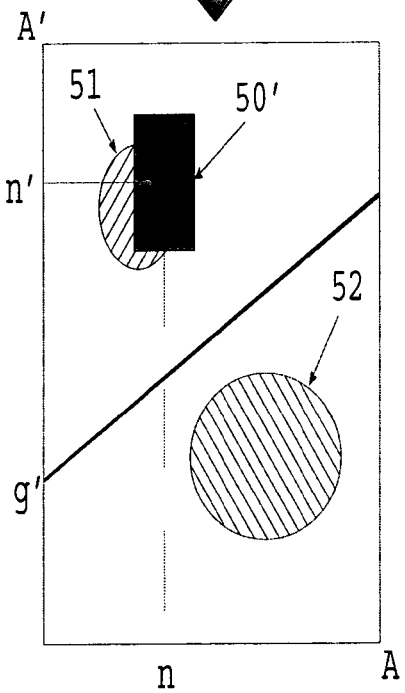
Figure 7b
Figure 7

METHOD AND DEVICE FOR SORTING PRODUCTS

FIELD OF THE INVENTION

The current invention relates to a method and apparatus for inspecting a stream of products. This inspection can further result in a quality selection by means of a sorting step.

The invention is applicable when removing certain degraded products and foreign objects from an incoming stream of products.

The invention is particularly suited for sorting food products such as green beans, peas, nuts, raisins, cauliflowers, lettuce and such like for which non-food products such as wood, plastics, glass and others need to be removed from the stream of products.

The invention is furthermore extremely suitable for sorting non-food products such as plastics from recycling garbage, sorting of glass and such like.

STATE OF THE ART

It is known from the international patent application WO 01/00333 that product objects in a stream of products can be illuminated with a concentrated beam of light. The reemitted light is captured by a detector whereupon it is analyzed. Based on this analysis a selection mechanism can be controlled to achieve a certain sorting result.

In the absence of product, the light is reflected by a background element that needs to be chosen product dependently. More specifically, the background needs to be chosen such that it shows the optical characteristics of good product. In other words, the good product is invisible against the background. However, deviations in an analyzed product such as insect bytes, putrescent stains, foreign objects and such cause a deviation in the returned light signal. By adjusting a threshold one can make the difference between the light signal coming from the background and acceptable products on the one hand and the light signal coming from unacceptable product to be removed on the other hand.

Similar background elements are described in the American patent U.S. Pat. No. 4,723,659 and the European patents EP1012582 and EP0443769. Generally speaking it concerns a background element positioned perpendicular to the direction of product movement, in the field of view of the detecting means. Usually the background element is a cylindrical roller. While rotating and with the aid of a scraper it becomes self-cleaning.

A disadvantage of this method is that for each kind of product a specific background element needs to be available. Thus a background element for carrots should have an orange color, while for green beans it should have a green color. During the sorting of food products and more specifically while switching from one product to another, it is required to switch the background element as well. Furthermore, the cost of a background element is not negligible.

In certain applications the background element is given additional optical properties. Many fresh vegetables contain for example chlorophyll. A frequency shift towards the infrared spectrum occurs within these molecules when illuminated with light having a wavelength between 640 and 680 nanometer. This emission phenomenon is called fluorescence. By giving the background element the same fluorescent properties one can, in the state of the art, additionally sort based on the presence of chlorophyll in the analyzed products. Other molecules, such as aflatoxin, show fluorescent properties as well and could in principle be detected in the analyzed products according to a similar technique.

An important disadvantage is that over time these kinds of background elements loose their fluorescent properties. This has adverse effects on the sorting quality and is also uninteresting for the users of such equipment.

For these reasons there is a need for a sorting device, in particular an inspection device, without the disadvantages of the devices known in the state of the art.

For these reasons there is need for a method not showing the disadvantages of the current state of the art.

OBJECTS OF THE INVENTION

In general the object of the invention is a method and apparatus to carry out a selection between products in a large, continuous stream of products in a very effective, reliable and cost-effective way.

More specifically, according to a number of preferred embodiments, the invention aims at an inspection method and inspection means avoiding the replacement of the background element during a product switch.

In other words, the object of the invention is an inspection method and inspection means using a background reference which is at least product domain independent.

SUMMARY OF THE INVENTION

The method of sorting products according to the invention is characterized at least by transporting the products to sort along a certain trajectory in the form of a product stream having a width; a background element extending along the width of the product stream; with a concentrated light beam illuminating along the width of the product stream, the products to sort and, in absence of said products, the background element; capturing the light reemitted by the products and the background element; based on said observed light carrying out a first selection between the background element on the one hand and all the products in the product stream on the other hand; carrying out a second selection between the products to sort on the one hand and the products to be rejected on the other hand and based on this second selection automatically carrying out a separation of the products in said product stream.

Preferably the background element comprises a surface extending along the width of the product stream, whereby said surface reflects the incoming light at least partially.

In a particularly useful embodiment the background element has the shape of a cylindrical roller.

In an alternative embodiment the background element comprises means to capture and redirect the incoming light towards an opto-electrical convertor. In this case such a background element generates a signal having a progression from which the presence or absence of products in the scanning zone can be easily deduced. A thus obtained Boolean signal is particularly useful in the method according to the invention.

The first selection is preferably done based on whether or not the intensity of the detected light or a derived signal thereof crosses a threshold value.

In certain cases, more specifically when the total range of products features positive as well as negative peaks against the background signal, the first selection is done based on whether or not the intensity of the observed light emitted by the background element or a derived signal thereof falls within a zone, said zone further characterized by a maximum threshold value.

The second selection is preferably done based on whether or not the intensity of the detected light or a derived signal thereof crosses a threshold value.

In a preferred embodiment said crossing of a threshold value is exclusively defined within those zones which are labeled during the first selection step as originating from product.

In an exceptionally preferred embodiment a new signal is generated after the first selection, further characterized by preserving the intensity of the observed light in those zones outlining product (the product zones) and subsequently changing the intensity in the zones where the background element can be observed to another level.

Additionally it is preferable to filter said signal such that the high-frequency transitions at the product zones are flattened and a new signal is created. Said filter could for example be an adaptive filter specifically tuned to smooth the transition from product zone to background zone and vice versa.

In the most practical embodiment according to the invention the second selection is done on said filtered signal.

In any case the selection of the background element will be such that it leads to at least one corresponding signal having a path according to which a first selection can be carried out between said background element on the one hand and all products in the product stream on the other hand.

In a practical embodiment of the method according to the invention the scanning is done using a rotating mirror, preferably a fast rotating polygonal mirror.

In a very practical embodiment the scanning uses a laser beam.

In a practical embodiment the products are transported on a vibrating table, belt or suchlike, towards an inspection installation.

In some cases, more specifically in the case of free-fall sorting devices, the products are further guided during their free fall by a free-fall plate. Furthermore, the products to separate are segregated by means of a manifold of air valves positioned along the width of the product stream and opened based on the second selection step.

In some cases, more specifically in those cases where defects are situated on both sides, it is advantageous to scan the products to sort from two sides, opposite from each other.

The method could be combined with color sorting by sorting based on light reflections.

Additionally different concentrated light beams having each a different wavelength, possibly combined into one bundle, could be utilized.

In an important variant according to the invention two signals are combined in a two-dimensional graph such that each point in this graph corresponds with a specific intensity level according to the path of the first signal combined with a specific intensity level according to the path of the second signal; the points corresponding with the product to be accepted are grouped in first zone; the points corresponding with products to reject are grouped in a second zone; the points corresponding to the background element are outlined by a third zone; adjusting the level of the background signal is realized by repositioning the third zone to a new location.

In this case moving said third zone can be achieved by visualizing this zone in a graph displayed in a graphical user interface and subsequently dragging this zone to a new location.

In a preferred embodiment this said new location is chosen such that a separation can be made between the first and the third zone on the one hand and the second zone on the other hand using a separation plane.

Additionally more than two signals can be combined into a more-dimensional graph.

Apart from said method, the invention also refers to an apparatus to sort products using this method and such that it comprises at least a transport device to transport a stream of products, extending over a width, into a specific direction; means to scan the products to sort along the width of the product stream, further comprising means to generate a concentrated light and direct it towards means to cast this light beam onto the products; means to capture the returning light; means to carry out a selection between the scanned products based on the observed light; means to separate the products based on this selection.

In a preferred embodiment the means to generate the concentrated light is a laser generator.

In a preferred embodiment the means to cast the light beam onto the products comprises optical means, more specifically a rotating polygonal mirror, moving the concentrated light transversely across the product stream. The current invention is however not limited to such a scanning arrangement. It could, by way of example, as well generate a row of concentrated light beams, possibly turned on and off in sequence.

Additionally the means to carry out a selection based on the returning light could be based on digital electronic components, more specifically Field Programmable Gate Arrays and microprocessors, or could be based on analogue electronic components such as operational amplifier circuits, or it could be a combination of analogue and digital processing units.

In a practical embodiment the means to make a separation between the products based on said selection are composed of a manifold of air valves, mounted transversely across the product stream.

In an advantageous embodiment the background element is composed of a surface across the width of the product stream, such that the incident light is at least partially reflected by said surface.

In an alternative embodiment the background element is composed of means that capture and channel the incident light towards means to convert this light into an electric signal.

In a preferred embodiment the means to capture the returning light are composed of an optical filter making the detection arrangement sensitive for a specific light spectrum, in operable communication with a spatial filter making the detection arrangement sensitive for a specific zone of the returning light, and in operable communication with both filters an opto-electrical converter transforming the light into a corresponding electric signal.

A method for sorting a stream of products in products to be accepted and products to reject comprising the steps of moving through a scanning zone the products to sort, supplied in a product stream spanning a certain width and having a thickness of substantially a single layer of products, in this scanning zone linearly scanning one or more concentrated light beams across the width of this product stream, illuminating, in the absence of products, a background element positioned behind this product stream that extends over the width of it, whereby this light beam produces light signals at these scanned products and at this scanned background element, detecting these light signals whereby these light signals are converted in electric signals, generating one or more control signals on the basis of these converted signals whereby these control signals allow making a selection between the scanned products to be accepted on the one hand and the scanned products to be rejected on the other hand, and sorting the product stream by means of these one or more control signals, characterized in that this method further comprises; choosing this background element) such that the corresponding detected light signal differs in at least 1 parameter from the light signals of the products to sort and whereby generating one or more control signals further comprises shifting the background level of the converted signals after detection of the light signals, towards a new signal level chosen such that, in the thus obtained signal, the signal level of the signal of a scanned product to be accepted differs from the signal level of a scanned product to be rejected. The parameter in which the background element can differentiate itself from the products to sort can be the signal level, a spatial aspect such as scattering or a frequency aspect such as color information.

This method can further comprise, after moving the background level of the converted signals, comparing the thus obtained signal with one or more threshold values to generate in this way the one or more control signals.

Moving the background level according to this method can further comprise generating a signal which is indicative of the location of the scanned products in the detected and converted signals and shifting the level of the converted signals to locations other than these of the scanned products such as have been indicated by this location signal.

Generating the location signal according to this method can further comprise detecting and converting the light signals originating from the scanned background element and from the scanned products, in these converted signals separating the signal originating from the scanned background element from the signals of the scanned products such that a signal is obtained indicative of the location of the scanned products.

Distinguishing the signal originating from the scanned background element according to this method can further comprise comparing the converted signals with one or more threshold values.

In an alternative embodiment of these methods generating the location signal can further comprise detecting and converting that zone of the concentrated scanning light beam passed by the products, as such obtaining a signal that is indicative of the location of the scanned products.

The location signal in the different embodiments of this method can be a Boolean signal. Shifting the signal level to a new signal level can then happen according to the formula $D=BC+s(C\oplus 1)$, in which B is the detected and converted light signals, s a real number chosen in function of the desired shift of the signal level, C the location signal, and $\oplus$ is defined as the modulo-2 addition.

The location signal in the different embodiments of this method can be a Boolean signal. Shifting the signal level to a new signal level can then happen according to operation $D=B$ when $C=1$ and $D=0$ when $C=0$ and in which B is the detected light signal, and C is the location signal.

The location signal in the different embodiments of this method can be an analogue or digital signal, whereby comparing the thus obtained signal with one or more threshold values happens only on the location of the scanned products as indicated by the location signal.

The background level of the converted signals can be shifted towards a signal level according to that of a product to be accepted.

The location signal in any embodiment can be generated on the basis of one or more first detected signals and afterwards used to indicate the location of the products in one or more second detected signals.

The background element in any of the embodiments can consist of a surface that extends over the width of the product stream, whereby said surface at least partially reflects the incident light. Preferably this background element has the shape of a cylindrical roller.

In an alternative embodiment this background element consists of means to capture and redirect the incident light towards a opto-electrical convertor. In this case the background element can be an optical fiber with a grooved surface to capture the incoming light. Such optical fiber can consist of segments, whereby for each segment the orientation of these grooves with respect to the longitudinal direction of the optical fiber is chosen in function of the position of this segment along the width of the product stream.

In any embodiment according to this method the thus obtained signal can be filtered prior such that the high-frequency transitions near the product zones are flattened, generating a new filtered signal. This filter can be an adaptive filter which is adjusted specifically to smooth the transitions from a product zone to a background zone and vice versa.

In any embodiment according to this method the linear scanning of the product stream can happen by means of a moving mirror, preferably a rapidly rotating polygonal mirror. The product stream can be scanned by several concentrated light beams by means of this moving mirror, whereby every light beam has a separate frequency. Preferably this concentrated light beam is a laser beam. The products to sort can be scanned from both edges of the product stream.

In any embodiment of this method the supply of the product stream can happen by means of a vibrating table, a conveyor belt or suchlike. The products can further be supplied by means of a free-fall plate which guides these products during their free fall towards the scanning zone.

In any embodiment of this method the sorting of the product stream by means of these one or more control signals can happen by controlling a manifold of air valves positioned across the width of the product stream by means of these one or more control signals.

In any embodiment, besides at the signal level, sorting the product stream can also happen on color, i.e., the frequency of the detected light signals.

In an embodiment of aforementioned methods whereby generating one or more control signals by means of moving the background level of the converted signals to a new signal level chosen as such that, in the thus obtained signal, the signal level of the signal of a scanned product to be accepted differs from the signal level of the signal of a scanned product to be rejected, further comprising; combining two detected and converted signals in a two-dimensional graph, in which each point corresponds with a particular intensity level according to the path of the first signal combined with a particular intensity level according to the path of the second signal; the points which correspond to product to be accepted are grouped in a first zone; the points which correspond to product to be rejected are grouped in a second zone; the points which correspond to the background element are outlined by a third zone; adjusting the level of the background signal is realized by repositioning the third zone to a new location. Moving said third zone can happen by visualizing this zone in a graph displayed in a graphical user interface and subsequently dragging this zone to a new location. This said new location can be chosen such that a separation can be made between the first and third zone on the one hand and the second zone on the other hand. This two-dimensional graph can have an additional dimension showing the histogram of appearing signal combinations. Furthermore, more than two detected signals can be combined with each other in more-dimensional graph so that, for every location in the scanning zone, as much as possible optical information is collected and depicted, allowing to make a better distinction between the location of the products to be sorted and these of the background on the one hand and between the products to be accepted and products to be rejected on the other hand. All or at least one of said first, second and third zones in such two or more-dimensional graph can be inferred by automatic clustering algorithms.

An apparatus for sorting products according to the methods of any of the previous claims, characterized by at least consisting of a supply system transporting a single layer of the products to be sorted along a certain trajectory in the form of a product stream extended over a width; means to scan to products to be sorted over the width of this product stream, whereby these scanning means further comprise; means to generate a concentrated light beam and direct it towards the products via optical means; means to detect the returning light and convert it to an electric signal; means to generate control signals enabling to carry out a selection between the scanned products based on said detected light; and means to sort the product stream based on said selection by means of said one or more control signals, characterized in that the sorting apparatus further comprises; a background element chosen such that the corresponding detected light signal differs in at least 1 parameter from the light signals of the products to be sorted and whereby the selection means comprise means to generate one or more control signals by shifting the background level of the light signals towards a signal level chosen such that, in the thus obtained signal, the signal level of a scanned product to be accepted differs from the signal level of a scanned product to be rejected.

The selection means of such sorting device can further comprise means to generate a location signal based on one or more detected signals, means to obtain a signal based on this location signal and based on these or other one or more detected signals, such that the background level in these last signals is shifted to a new level enabling to differentiate products to be accepted from products to be rejected in said obtained signal.

These selection means can further comprise means to compare the obtained signal with one or more threshold values, in this way generating the one or more control signals.

These selection means can further comprise filters to priefilter the thus obtained signal so that the high-frequency transitions close to the product zones are flattened and thus obtain a new filtered signal. This filtering operation can be achieved by means of an adaptive filter specifically adjusted to smoothing the transitions from a product zone to a background zone and vice versa.

In any of the aforementioned sorting apparatuses this background element can consist of a surface that extends over the width of the product stream, whereby said surface reflects the light at least partially. Preferably this background element has the shape of a cylindrical roller.

In an alternative embodiment this background element can consist of means to capture and redirect the incident light towards an opto-electrical convertor. Such background element can be an optical fiber with a grooved surface to capture the incident light. Such optical fiber can consist of segments, whereby for each segment the orientation of these grooves with respect to the longitudinal direction of the optical fiber is chosen in function of the position of this segment along the width of the product stream.

A laser can be used in such sorting apparatuses to capture the concentrated light beam. This laser can be moved across the width of the product stream by means of a rotating polygonal mirror.

In such sorting apparatuses the means to make a selection between the scanned products in function of the observed light consist of a signal processing platform based on digital electronic components, more specifically Field Programmable Gate Arrays and microcomputer processors, or based on analogue electronic circuits, such as op-amp circuits, or a combination of analogue and digital processing units.

In such sorting apparatuses the means to sort the product stream in function of said selection by means of these one or more control signals, consist of a manifold of air valves, positioned transversely across the product stream.

In such sorting apparatuses the means to capture the light can consist of an optical filter making the detector sensitive to a particular light spectrum; in operational communication with a spatial filter making the detector sensitive to a particular zone of the returning light; in operational communication with both said filters an opto-electrical convertor converting the light to a corresponding electric signal.

SHORT DESCRIPTION OF THE FIGURES

Figure 3A:
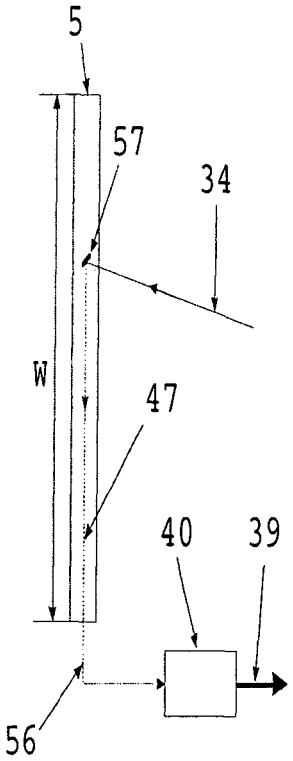
Figure 3B:
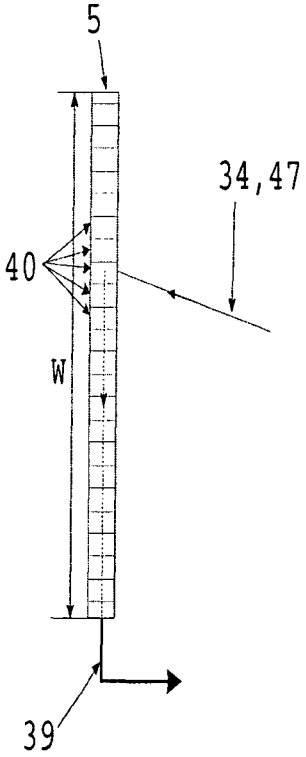
Figure 4:
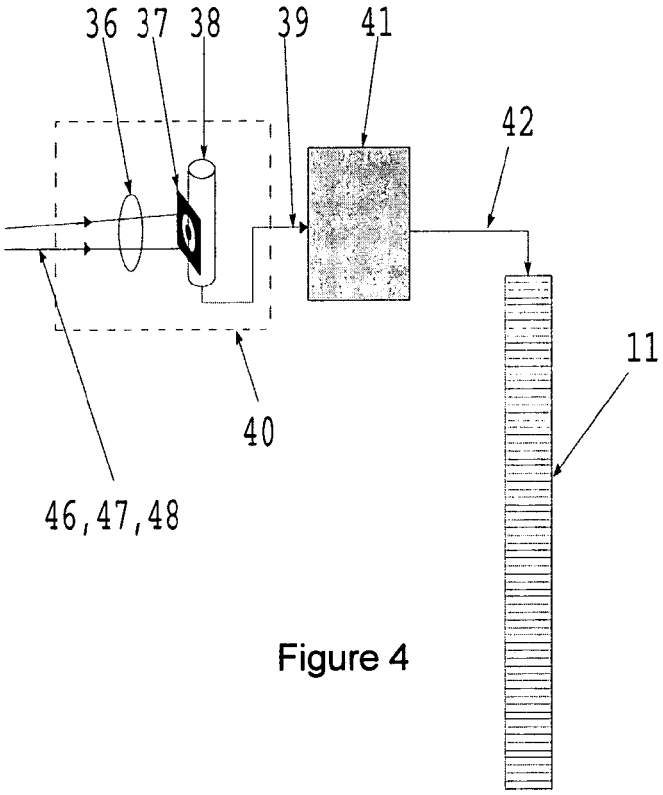
Figure 5:
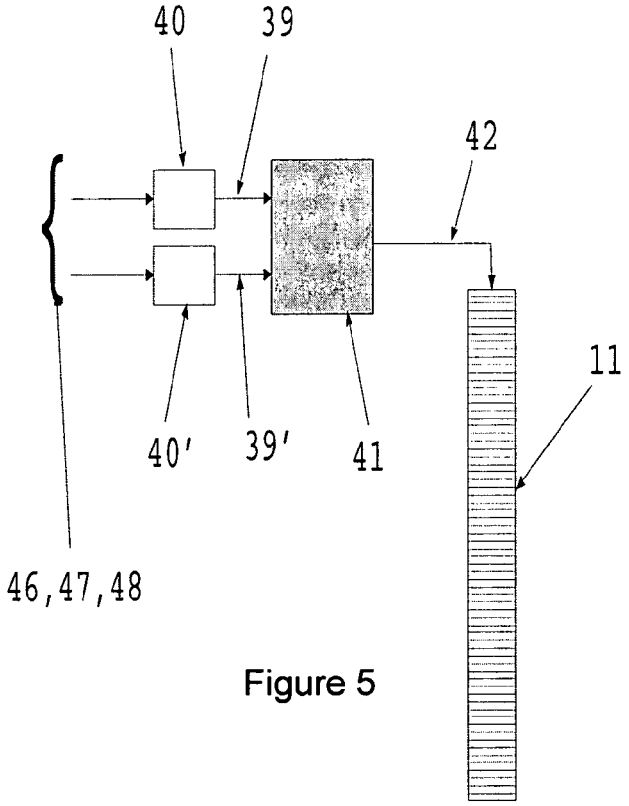
Figure 8:
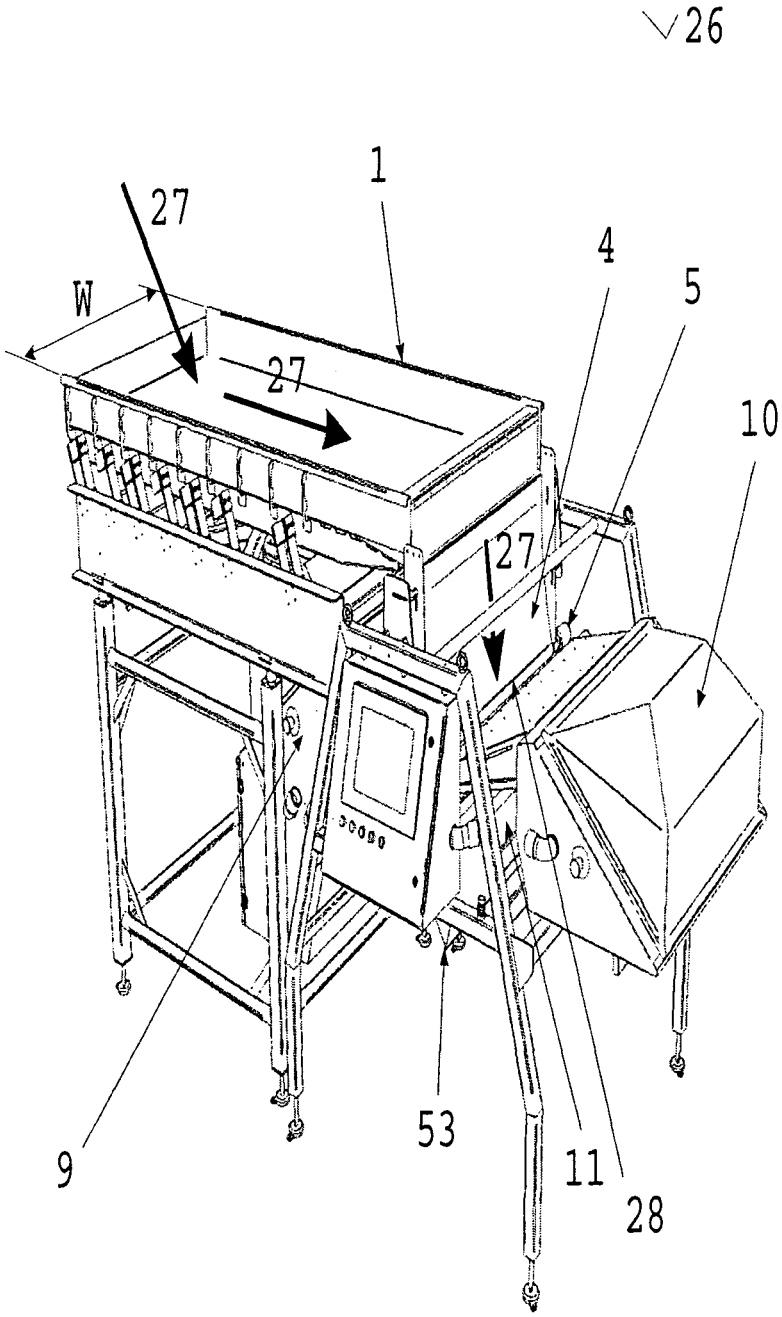
Figure 11A:
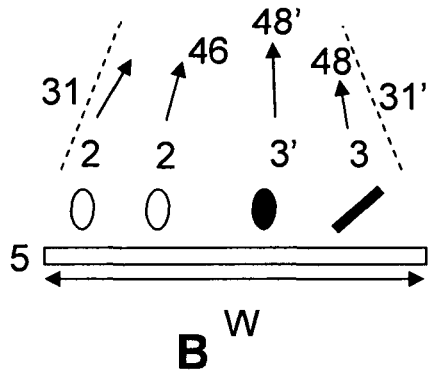
Figure 11B:
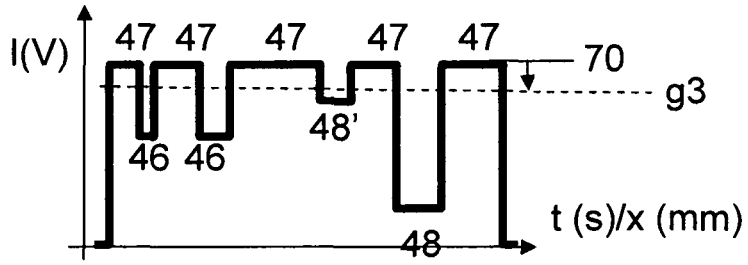
Figure 11C:
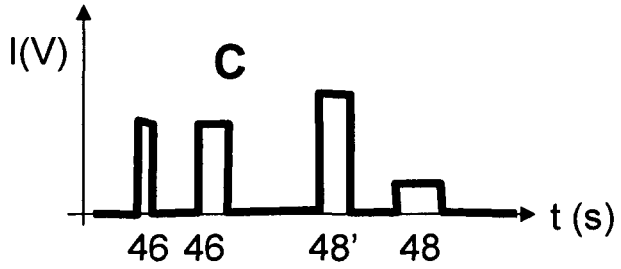
Figure 11D:
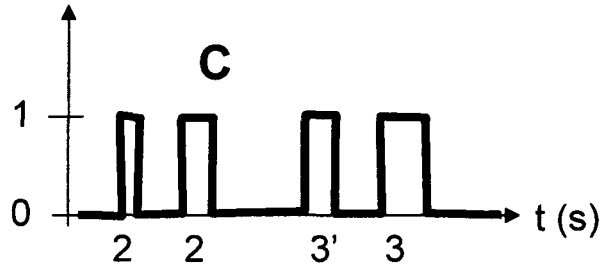
Figure 12A:
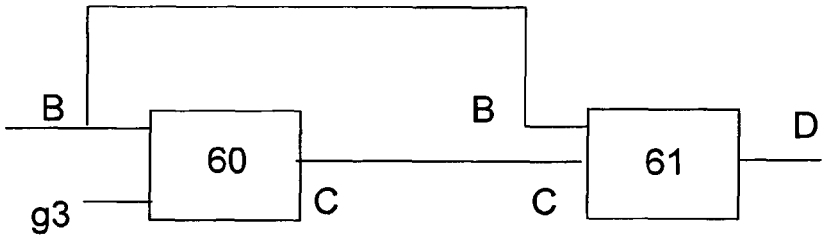
Figure 12B:
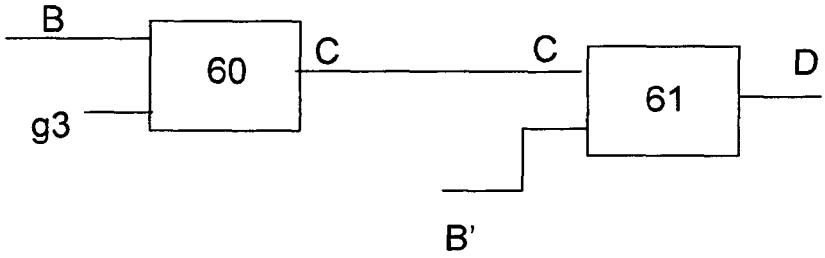
Figure 12C:
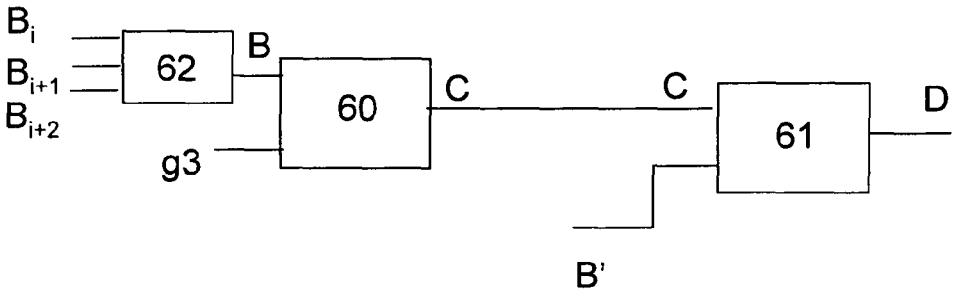
Figure 12D:
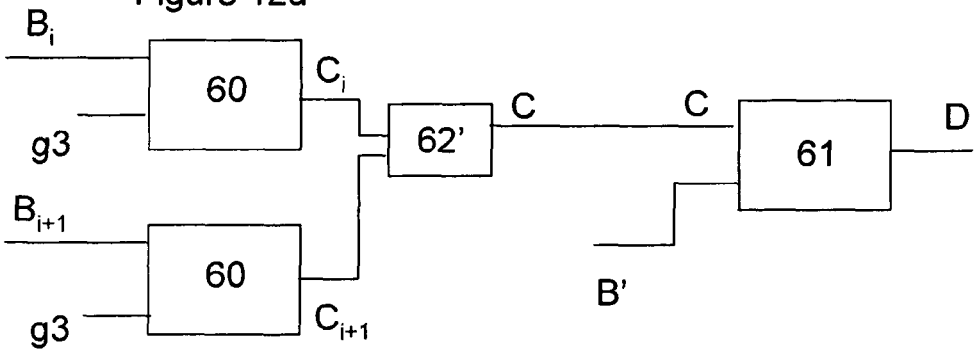
Figure 13A:
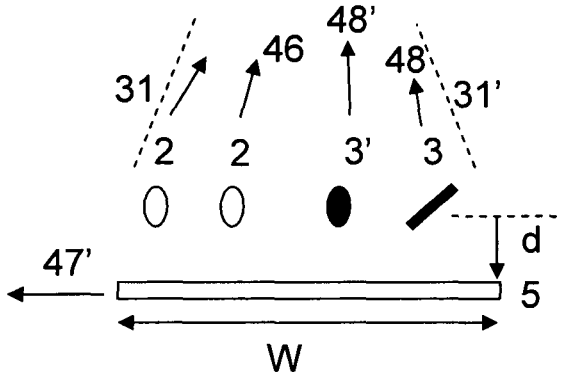
Figure 13B:
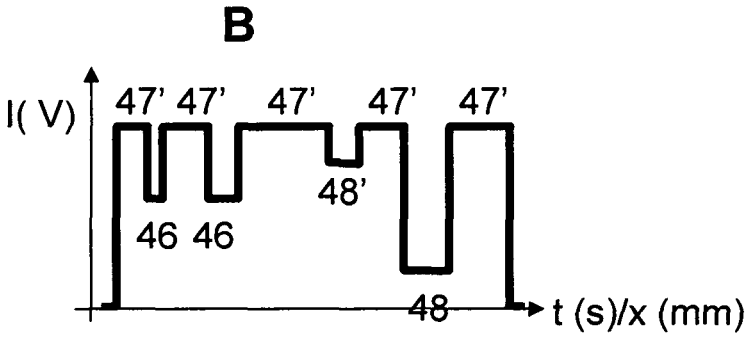
Figure 13C:
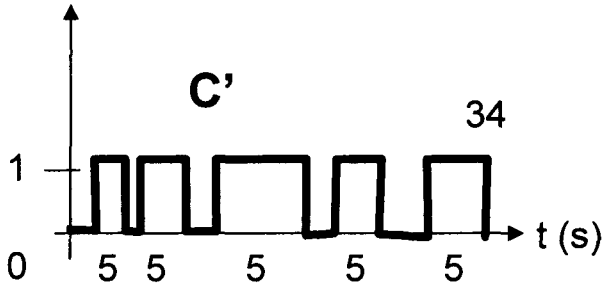
Figure 14:
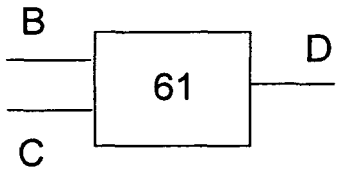
Figure 15A:
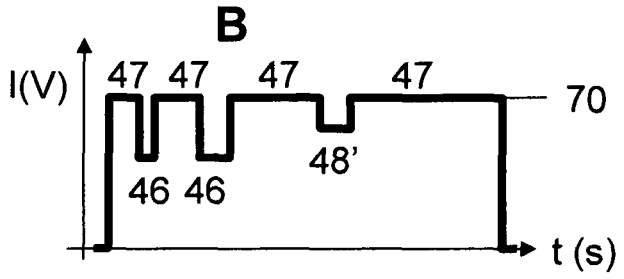
Figure 15B:
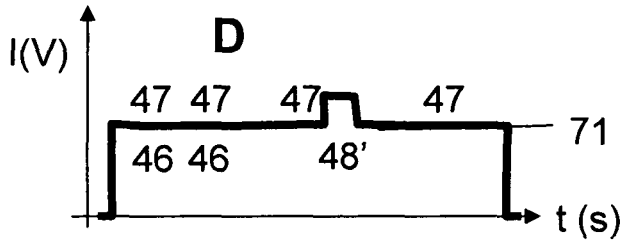
Figure 15C:
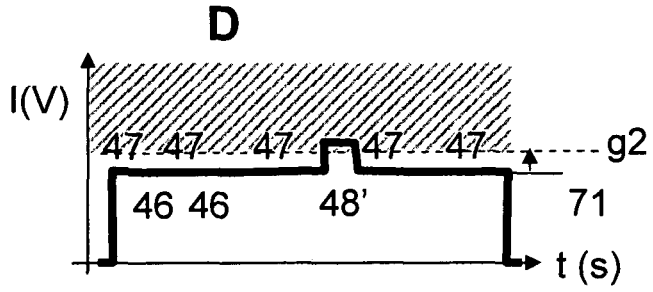

FIGS. 3*a* and 3*b* show alternative embodiments of the background element;

FIG. 4 illustrates schematically a detector device;

FIG. 5 illustrates schematically an apparatus with several detector devices;

FIGS. 6*a-e* illustrate the method in several steps according to the current invention which results in a better or at least more advantageous inspection;

FIGS. 7*a-b* illustrate this method in a two-dimensional representation;

FIG. 8 shows a sorting apparatus according to the invention in viewing perspective;

FIGS. 9*a-f* illustrate schematically the signal processing in an inspection device when the background element generates a signal that deviates from a good product FIGS. 10*a-d* illustrate schematically the processing of the signal according to an embodiment of the invention FIGS. 11*a-d* illustrate schematically the processing of the signal according to an embodiment of the invention FIGS. 12*a-d* illustrate schematically the processing of the signal according to an embodiment of the invention FIGS. 13*a-c* illustrate schematically the processing of the signal according to an embodiment of the invention FIG. 14 illustrates schematically the processing of the signal according to an embodiment of the invention FIGS. 15*a-c* illustrate schematically the processing of the signal according to an embodiment of the invention

DETAILED DESCRIPTION OF THE INVENTION

The current invention will be described by means of a few examples, referring to certain figures, without any restrictive kind. The figures are only schematic and not limiting. In the figures, the dimensions of certain elements can be exaggerated or not in true proportion. This is because of illustrative considerations. For this reason, the dimensions and relative dimensions do not necessarily correspond to reality.

The current invention teaches a method and a mechanism for sorting products 2, 3, to be precise, granular products like raisins, beans, berries, but also plastic grains, that are conveyed in large quantities and in a continuous stream.

In addition, the method according to the invention is also suitable for inspecting larger products like broad beans, cauliflower, lettuce, etc.

Figure 1:
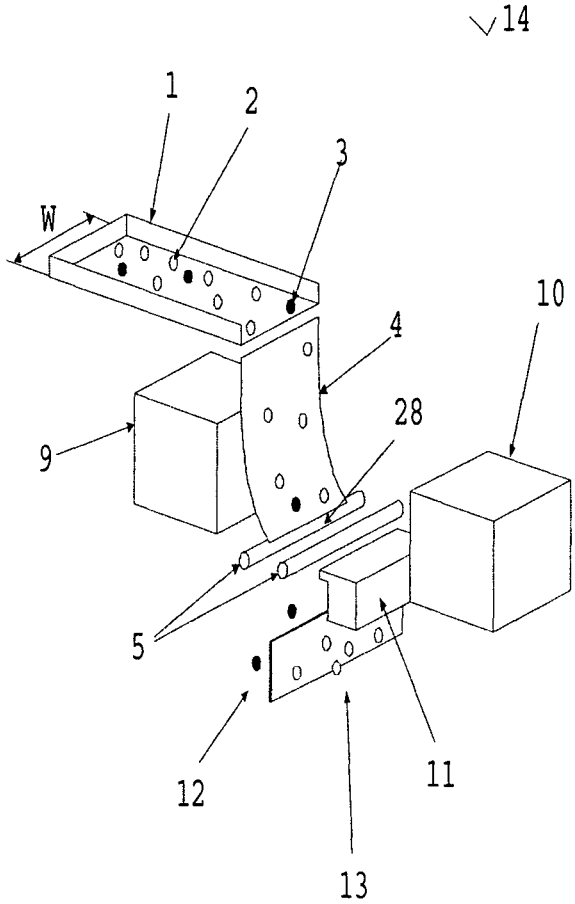
FIG. 1 illustrates schematically the fundamental operation of a sorting apparatus according to the invention.

FIG. 1 shows schematically a sorting apparatus 14 according to the current invention. This sorting apparatus contains an supply system 1, at least one inspection unit 9,10, a reject system 11 and possibly a free fall glide 4 that guides the product stream in free fall to the inspection unit 9,10 and the reject system 11. The glide, however, can also be a conveyor belt that conveys the products 2, 3.

The supply system 1 with width W can be a vibrating table, or any other conveyor system known in the current state of the art. In case supply system 1 is being executed as a conveyor belt, the use of a free fall glide can be superfluous, as is well known by the person skilled in the art.

In the scanning zone 28, the inspection unit watches the falling product 2,3 by analyzing the returning light. In function of this analysis, a reject system 11 is being controlled. This results in a separation of the product stream in an accept stream 13 and a reject stream 12.

Behind the scanning zone 28, a background element 5 is illuminated and observed while no product is present 2,3 in that zone 28. The optical properties of the background element 5 are chosen in such a way that a proper distinction can be made between all products 2,3 in the product stream on the one hand and the background element on the other hand. These optical properties can refer to the frequency or to spatial properties of the background element 5. The background element can generate a light signal with another frequency or reflect the incident light 34 in another way, or even scatter it. This method differs from the current state of the art, which tries to make a distinction between all the products to be rejected 3 from the product stream on the one hand and the background 5 together with the products to be accepted 2 on the other hand. For this reason, in the current invention the choice of the background element 5 becomes considerably less complicated and independent of the product domain. For instance, the background element 5 will be the same for green beans and orange carrots. As opposed to the current state of the art, in which a specific background element for every product has to be available which has optical properties identical to those of the products to be accepted 2. In the case of green beans and carrots, the current state of the art would need two different background elements: one with a green color, and another with an orange color. When the products to be sorted 2,3 are transported by a conveyor belt 1, this conveyor belt can be used as background element to obtain a background signal that differs from the signal of all the products 2,3, as is described in the embodiments of the invention.

In a preferred embodiment of the current invention, the background element 5 is a cylindrical roller, to be precise, a rotating roller that cleans itself by means of a scraper that is placed against the roller.

In a preferred set-up for the sorting of fresh vegetables such as green beans, carrots and peas, the background element 5 is implemented as a white, strongly scattering, not fluorescing, cylindrical roller. A signal 39, measured by a detection unit 40, only sensible to the scattered light, will in this case show a path B along which a proper distinction can be made between the background signal 19 on the one hand, and the peaks 20,21 originating from green beans, peas, carrots, wood, plastic, metal, glass etc. on the other hand.

In an alternative version, the background element 5 is an intrinsic component of the mechanical construction and contains, besides the function of optical background, an additional function as mechanical support element. As a result, it can, as such, not be removed. Such greatly simplified mechanical embodiment according to the current invention is impossible to implement in the current state of the art.

The inspection unit 9,10 consists of a scanning unit 43 and a detection unit 44. The scanning unit illuminates the product stream along the entire width W. The detection unit 44 captures a zone of the returning light and will convert this returning light by at least one opto-electrical converter 38 to an electric signal that is afterwards analyzed in a processing unit 41.

Figure 2:
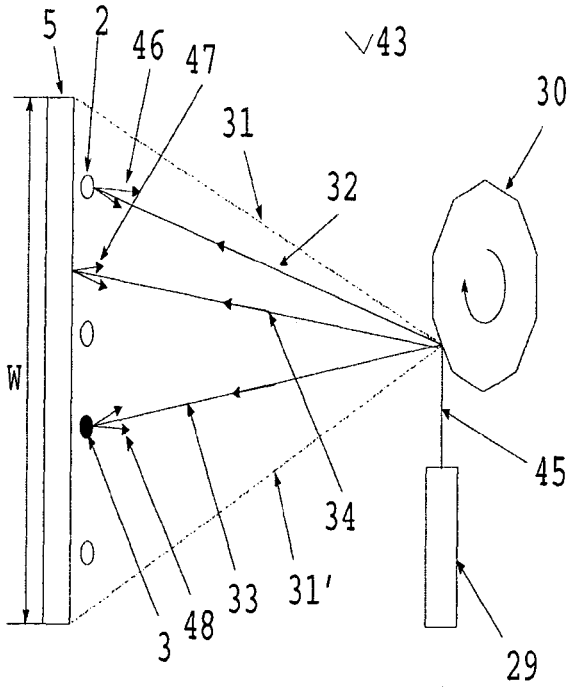
FIG. 2 illustrates schematically a possible embodiment of a scanning device.

FIG. 2 illustrates a possible embodiment of an inspection unit 43. A concentrated light beam 45, preferably originating from a laser 29, is directed towards a fast rotating, reflecting polygon wheel 30. During the rotation, this polygon 30 generates a fast moving concentrated point of light directed towards the product stream. The scanning is performed along the entire width W with a scanning angle determined by the extreme light beams 31,31'.

When this light 32,33,34 incides on a product 2,3 a zone of the light 46, 47, 48 will be reflected according to the color of this product 2,3. This makes color sorting possible.

Dependent on the light permeability of the illuminated product 2,3, the concentrated light beam 32,33,34 will be reflected directly and/or scattered, as is elaborately described in the American patent U.S. Pat. No. 4,634,881. This makes structure sorting possible. Additionally, the presence of fluorescing molecules in the product 2,3 will cause a frequency shift in the reflected light, making it possible to sort on the presence of those molecules, like chlorophyll and aflatoxin.

Entirely within the scope of this patent, various light beams with different wavelengths can be bundled, preferably by combining various lasers of different wavelengths by means of mirrors and optical filters.

In FIGS. 3*a* and 3*b*, an alternative version of the background element 5 is clarified, whereby this element consists of means to capture the incident light 34 and to direct it to a detection unit 40 that converts this light into an electric signal 39.

As is illustrated in FIG. 3*a*, the background element 5 can consist of an optical fiber 56, on which, by means of a closer specified mechanism 57, the incident light 34 can be further channeled to a detection unit 40 that generates an electric signal 39. The element 57 can for example consist of grooves or little mirrors attached to the fiber 56, so that the light gets bended towards the abovementioned filter 56.

In international patent application WO 2007/062219 and in zone 2 "Design and fabrication" of the article "A fiber grating based distributed light source", by G. E. Carver, Proc. Of SPIE Vol. 6371, 63710H-2 (2006), both integrally enclosed in this description, a grooved optical fiber is used to obtain a linear uniform light source. Light injected in the optical fiber in its longitudinal direction, is redirected in a direction differing from the longitudinal through grooves in the side of the fiber. The redirected light can be further guided through a cylindrical optical system to obtain a more uniform light distribution within a restricted area.

According to the choice of the geometric parameters of the grooves (cf. FIG. 5 of WO 2007/062219 or FIG. 2 of the SPIE article: width, pitch d, angle of the groove in relation to the normal direction perpendicular on the longitudinal direction, angle of the groove in relation to the longitudinal direction) and of the optical parameters (wavelength of the light source, refraction index of the optical fiber), the direction and the degree of the redirection can be determined. The grooves can be applied by means of a printer that uses laser light or UV light (cf. chapter 2, second paragraph of the SPIE article, p. 9 third paragraph illustrated by FIG. 5 of WO 2007/062219). By varying the relative orientation of the optical fiber in relation to the printer, the angle under which the grooves are formed in the side of the optical fiber can be determined.

Such optical fiber can, however, also be used to capture light originating from a linearly moving concentrated light beam 34 and to redirect it in the longitudinal direction of the optical fiber to an exit as illustrated in FIG. 3*a*.

As already mentioned in these publications, a grooved optical fiber of arbitrary length can be obtained by coupling separate segments (cf. SPIE article, chapter 2, last paragraph). Therefore, an optical fiber can be made that extends over de entire width W of the product stream. Accordingly, for every immediate position of the concentrated light beam, such a grooved optical fiber can capture the, in the absence of products, uninterrupted light 34 and redirect it to a detection unit 40.

Because the angle, formed by the uninterrupted light and the optical fiber used as background element 5 in FIG. 3*a*, depends on the position according to the width W, it can be necessary to vary the orientation of the grooves along the length of the optical fiber. After all, the uninterrupted light bundle 34 will enter the fiber substantially perpendicularly in the middle of the product stream, if the inspection unit 10 is set up symmetrically in relation to the width of the product stream. Moving to the edges of the product stream, the uninterrupted light beam 34 will, however, incide on the optical fiber 5 under a certain angle.

This can be prevented in two manners. As mentioned above, the optical fiber can consist of coupled segments. For every segment of the optical fiber, the orientation of the grooves can be kept the same. This can lead to an efficient production of these segments. Every segment in the optical fiber 5 can be placed under another angle, depending on the position according to the width of the product stream. A segment in the middle of the product stream will be placed in a substantially parallel position in relation to the product stream, while segments on the edges of the product stream are placed under an angle in relation to the product stream, correspondent to the angle formed by the light beam 34 and the product stream. Because of this variable orientation of the segments throughout the width of the product stream, the uninterrupted light 34 will always incide on the grooves under substantially the same angle and will be captured and redirected in the same way. Preferably, the segments are placed on an arc described by the concentrated light beam 45 when scanning the product stream.

As mentioned above, the optical fiber can consist of coupled segments. For every segment of the optical fiber, the orientation of the grooves can be changed. After all, the orientation of the grooves can be chosen separately for every segment by setting the relative orientation of the printer accordingly. The orientation of the grooves of a segment can therefore be adapted according to its position in relation to width of the product stream and to the angle formed by the inciding light beam 34 and the product stream at that point. In this embodiment of FIG. 3*a*, all segments of the optical fiber will be placed substantially parallel to the product stream. The orientation of the grooves of a segment will, however, depend on the position along the width of the product stream according to the angle formed by the inciding uninterrupted light bundle 34 and this position. This way, the uninterrupted light 34 will each time form substantially the same angle with the grooves. The light will also be captured and redirected in the same way.

An alternative as illustrated in FIG. 3*b*, consists of implementing the background element 5 as a manifold of little detector units 40 that convert the incident light in an electric signal 39. In the embodiment illustrated in FIG. 3*b*, the background element can be constructed as a linear array or line of light sensitive elements, such as photodiodes or Photo Multiplier Tube (PMT) or other elements known to the person skilled in the art. Because such linear array is usually constructed as a line of separate light sensitive elements 40, i.e. separated from each other, it is possible that an uninterrupted light bundle 34 does not incide on a light sensitive element 40. One could wrongly conclude that a product 2,3 was present in the product stream that obstructed the concentrated light bundle. To avoid the discontinuous light detection, one could provide a limited light scattering effect when a uninterrupted light beam reaches the background element 5. One can apply a coating on the background element that scatters the incident light when the background element 5 itself is being scanned. This light scattering coating can for example be a milky plastic layer or a glass plate. Using this limited light scattering one can make sure that two or more nearby light sensitive elements 40 get illuminated, even if the uninterrupted light beam 34 should reach the background element 5 between two such light sensitive elements 40. After all, it is important to know whether an uninterrupted light beam 34 reaches the background element 5, rather than the position where the background element 5 is illuminated. This position can be deduced from the known immediate position of the scanning light bundle and by correlating the time period of the signal 47, coming from the background element 5, with the time period of the moving light bundle.

The signal on the exit of the detecting background element 5, as illustrated among others by FIGS. 3*a* and 3*b*, can be processed further. The electric (FIG. 3*b*) or optical (FIG. 3*a*) signal at the exit of such a background detection element 5, can be filtered to withhold only the signal components coming from the uninterrupted light beams 34, while the ambient light is being filtered away. The signal components will typically have a higher frequency, than signal components coming from background light. A DC-filter or high-pass filter can usually be enough for only allowing the wanted higher-frequency signal components, characteristic for the presence of a product 2,3, passage for subsequent signal processing as discussed in this description.

FIG. 4 shows schematically a detector unit 40, struck by the incident light or light cone 46, 47, 48, and that subsequently converts said light, or a particular zone of it, into an electric signal by means of an opto-electrical convertor 38. This electric signal 39 is given as input to a processing unit 41, which by means of an analytic method generates a control signal 42 that controls a reject system 11.

According to the invention, optical filters 36 can be used to render the detector unit 40 sensitive to one specific wavelength by placing this filter 36 into operational communication with abovementioned opto-electrical convertor 38.

According to the invention, a spatial filter 37 can be used to block or to let through certain zones of the returning light 46,47,48. For instance, a spatial filter 36 can be used, which only lets through the scattered light. Such spatial filters are described in the American patents U.S. Pat. Nos. 4,634,881 and 4,723,659.

In a preferred embodiment, the spatial filter 36 consists of a diaphragm that is placed right before the opto-electrical convertor 38.

As is schematically illustrated in FIG. 5, more detector units 40, 40' can be set up according to the invention.

In a preferred embodiment, every detector unit 40, 40' uses a different combination of optical 36 and spatial 37 filters. Because of this, every detector unit 40,40' is sensitive to a specific zone of the returning light 46,47,48 having a specific wavelength. The output signals 39, 39' are representative of a specific zone of the returning light 46,47,48 on a specific wavelength.

The first detector unit 40 generates a first electric signal 39 with a level determined by the abovementioned optical and spatial filters chosen for that detector. The second detector unit 40' generates a second electric signal 39' with a level determined by the abovementioned optical and spatial filters chosen for that detector. The detector units 40,40' are in operational communication with the processing unit 41 via the signals 39,39'.

The processing unit 41 will perform a selection between the scanned products 2,3 and the background element 5, in function of the returning light 46,47,48, more specifically based on the electric signals 39,39'.

In a preferred embodiment according to the invention, the processing unit 41 is a digital processing platform based on Field Programmable Gate Arrays or microprocessors. The processing unit 41 could, however, also consist of analog op-amp circuits or a combination of analog and digital components as is known by the person skilled in the art.

Figure 6:
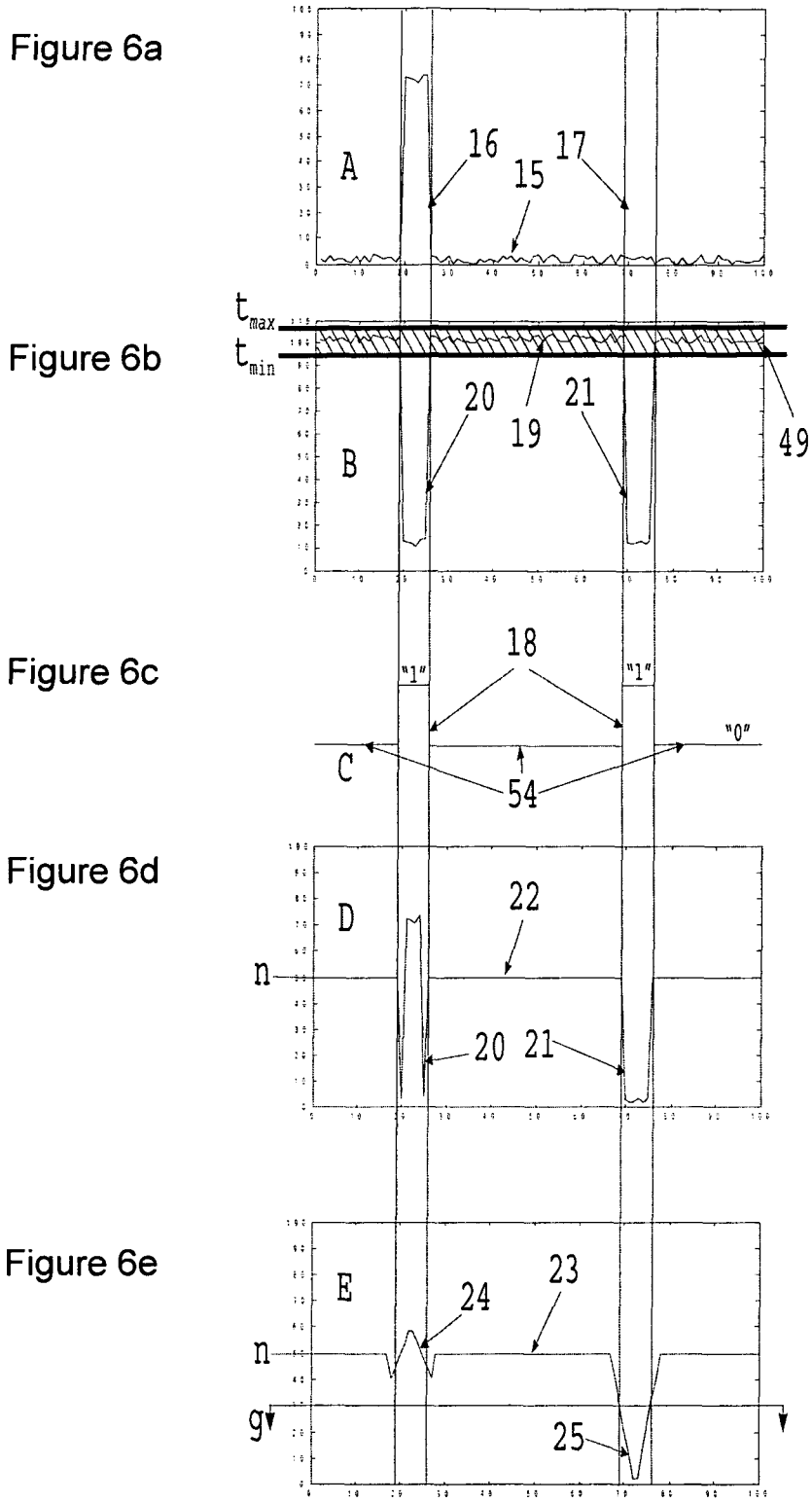

The method of the invention, as is illustrated in FIG. 6, consists of the light 45 having at least one wavelength, being sent out towards an inspection zone 28. This zone 28 is being scanned and when the above-mentioned light 45 strikes the product 2,3 or the background element 5, the emission 46, 47, 48 will be captured by at least two detector units 40, 40'.

In the processing unit 41, the incoming signals 39,39' can be combined into new signals A, B according to the formula:

$$A=n39+m39',$$

$$B=p39+q39'$$

where n,m,p,q are real numbers and 39,39' said input signals.

In an advantageous embodiment of the invention, factors m and p are equal to zero. This means in principle that no combination is made. In this case, detector unit 40 generates the signal A, and detector unit 40' the signal B.

As an example, without any limitation to the scope, we consider a detector unit 40 having an optical filter set to the light spectrum between 690 and 740 nanometers, more particularly the fluorescence spectrum of product 2 containing chlorophyll when illuminated between 540 and 680 nanometer. The signal A shows a possible path of such a set-up where a peak 16 is perceptible at the location of said product 2 containing chlorophyll.

The problem occurs when the signal level in zone 17, due to the products to be rejected 3, does not show a noticeable difference with the background signal 15. In that case, it is not directly feasible to make a distinction between the products to be rejected 3 on the one hand and the background element 5 together with the products to be accepted 2 on the other hand. Although this distinction must be made because only the products to be rejected 3 are allowed to give cause to a reject-action by means of a reject system 11.

In FIG. 6, signal A illustrates a path on which an emission phenomenon, that can only be attributed to the product to be accepted, is measurable. However, no selection is possible on such a signal because of the above mentioned problem.

The signal B, as illustrated in FIG. 6, is shown in function of the width W of the scanning zone 28. Zones 20,21 of the signal are the result of the emission that occurs on products 2,3, particularly as a consequence of the emission of both the products to be accepted 2 and the products to be rejected 3. Zone 19 is the result of emission of the background element 5.

On signal B, a zone 49 is defined in which the background signal 19 is situated. All zones 19 that are located within this zone 49, are labeled by the processing unit 41 as coming from the background element 5. To be precise, the zone 49 is determined by a maximum threshold value $t_{max}$ and a minimum threshold value $t_{min}$. In an advantageous embodiment, these threshold values $t_{max}$, $t_{min}$ can be adjusted by a user.

In order to better represent the next steps in the method according to the current invention, a Boolean signal C is introduced, whereby the value 0 is adopted at the locations of the background signal 54 and where the value 1 is adopted at the locations 18 outside the zone 49 on the signal B.

The current invention does, however, not exclude that in an alternative method, the Boolean signal C is effectively being generated or is directly available in the processing unit 41, for example in case of an embodiment as described in FIGS. 3*a* en 3*b*, wherein the background element 5 generates a signal 39 according to the path of signal B, which can be transformed in a manner as described above to said signal C. However, one has to observe that in this case, the selection between the products 2,3 and the background element 5, can take place using one threshold value $t_{min}$ only because the peaks 20,21 where the products 2,3 are located, are all on the same side of the background signal 19, all below (or all above) the background signal 19 to be precise.

In a possible next step, according to the invention, a new signal D is being generated using the formula:

$$D=AC+s(C\oplus 1),$$

wherein $\oplus$ is being defined as the modulo-2 addition.

In this way, the new signal D is an exact copy of the abovementioned signal A on places 20,21 of product 2,3. On the places where the background element 5 is being observed, a new value s is being established so that the background signal 22 clearly separates itself from the products to be rejected 3.

In the example described above, the path of signal A was interpreted as coming from the emission peak of a product 2 containing chlorophyll, against a non-fluorescing background. By generating the signal D, a distinction can be made between the background element 5 together with the products 2 containing chlorophyll on the one hand, and the products to be rejected 3 on the other hand, making it possible to automatically remove the latter products.

In a preferred next step, the signal D will be additionally filtered by, for instance, a low-pass filter, generating a new signal E. The low-pass filter is constructed according to known principles, for instance by means of digital multi-tap FIR filter. The cut-off frequency will be chosen in a way that the high frequency transitions on the edges of the zones 20,21 in the signal D are flattened sufficiently, without losing the actual signal content. In this way, one obtains the zones 24, 25, where the products 2,3 are, and zone 23, where the background element 5 is.

In an alternative form, the filtering is done by means of an adaptive filter that is tuned to apply a filtering to mainly only said transitions. In that case, the cut-off frequency chosen can be much smaller.

The current invention is not restricted to the use of low-pass or adaptive filters to flatten out said transitions. To be precise, all methods to realize such a flattening fall within the scope of this invention.

Based on the signal E is whether or not crossing a specific threshold value g, an automatic detection can be carried out at the locations 25 wherein the products to be rejected 3 are located.

Instead of generating signals D and E, according to the invention, an automatic detection can be carried out at those locations 17 wherein the products to be rejected are located, based on whether or not the signal A crosses a threshold value g, by merely analyzing said crossing in those zones wherein the products 2,3 are located according to signal C.

The signals A, A', B, C, D, E are synchronized with each other. After all, these signals originate from the concentrated light beams 45, scanning the product stream in temporal movement. Every immediate value of one of these signals can therefore be correlated to the corresponding immediate value of the other signals. This synchronization allows applying one signal to another signal or combining both, because at every single moment the signals are coming from the same scanned position. In FIGS. 6*a-e*, signals $A(t_A)$, $B(t_B)$, $C(t_C)$, $D(t_D)$ and $E(t_E)$, whereby $t_A$, $t_B$, $t_C$, $t_D$, $t_E$ depict the time dependence of these signals, can be correlated to each other because $t_A=t_B=t_C=t_D=t_E$, since all the signals are obtained through an light beam 45 temporally moving back and forth.

To actually remove the products 3, air valves 11 are opened so that, at the locations where these products 3 were detected, each such product 3 will be blown out of the product stream.

The operation of the reject system 11 is carried out by comparing control signals generated by the signals D, E, to one or more threshold values $g_i$. These control signals only contain information about either the product to be rejected 3, if this has to removed, or the product 2 to be accepted, if it has to be withheld.

This method according to the current invention is, of course, not restricted to the use of two detectors. In the case of more than two detectors, the corresponding signals 42 can for instance be algebraically combined to abovementioned signals A and B.

In an advantageous embodiment of the current invention, the zone 49, in which the background signal is located, is defined on various signals B, to be precise on all the output signals 39 of all the present detector units 40. The final Boolean signal C that determines where the background 19 is located and where the products 2,3 are located, is obtained by performing a logical-OR operation to all the separate signals C that are obtained according to the abovementioned method.

In an alternative embodiment, the output signals A, A' of two detector units 40,40' are combined in a two-dimensional graph. Both signals A, A' originate from the same position in the product stream, but can differ in one or more signal parameters, so that different optical properties of the scanned position at that moment can be analyzed. These signals A, A' can be obtained by filtering them out of a same detected light signal using spatial and/or frequency filters. Every point in this graph corresponds to a specific intensity level according to the path of the first signal A, combined with a specific intensity level according to the path of the second signal A' at a specific moment in time, or, in other words, for a known immediate position of the concentrated scanning light beam 45. Specific signal combinations can occur several times if products 2,3 with the same optical properties are being scanned or every time the background element 5 is being scanned. By keeping these statistics, a two dimensional histogram can be created. Additionally, a color can be attributed to every histogram value. By attributing, for example, blue to the lowest value and gradually move up to red per rising value, a two-dimensional intensity map 55 can be created. On this map 55 contours of equal intensity can be drawn. As shown in FIG. 7*a*, zones can be determined in which products with similar optical properties are clustered.

Every point in the two-dimensional diagram of FIG. 7*a* is being characterized by the intensity levels of the respective signals A, A' and by the corresponding value of the location signal C. Depending on the value of this location signal, the signal levels of a point in the histogram correspond to those of a product 2,3 or to the background element 5. Based on the information of the signal C for the individual signal combination A, A', it can be determined whether or not a product is concerned.

That way, in this perception, the zone 51 is being defined, in which the products to be accepted 2 are located, and the zone 52, in which the products to be rejected 3 are located. The zone 50, determined by the respective threshold values $t_{max}$, $t_{min}$ and $t'_{max}$, $t'_{min}$, is represented by a square in said intensity map 55 containing the background as is illustrated in FIG. 7*a*. However, the signal combinations of a product to be rejected 3, can be located in between the threshold values $T'_{max}$, $T'_{min}$ and $T_{max}$, $T_{min}$ containing the points corresponding to the scanned positions on the background element 5. FIG. 6*b* illustrates how the signal level of background signal 47 is located within a strip 49, limited by one or both threshold values $T_{max}$, $T_{min}$. When the background element 5 would not show variation in the corresponding signal 47, the background level would be one single line in FIG. 6*b* and one single point in FIG. 7*a*. In a realistic embodiment this background level can vary such that one obtains a matching set of points within the rectangle $T'_{max}$, $T'_{min}$ and $T_{max}$, $T_{min}$ that defines the strip 49 in FIG. 7*a*. As demonstrated in FIG. 7*a*, some points belonging to a product to be rejected 3, can have signal levels that cannot be distinguished from the background element 5. This is illustrated in FIG. 7*a* by the overlap between strip 50 and zone 52. This is also illustrated in FIG. 6*a* wherein the signal on position 17 of a product 3 that is to be rejected, cannot be distinguished from the signal on position 15 coming from the background element 5.

In a graphical user interface one can, by means of a simple operation as is illustrated in FIG. 7*b*, for example by a dragging move, move the square 50 to another location with coordinates n'n, such that the zone 52 that matches the products 3 to be rejected, can be isolated by means of a separation plane g'. On the basis of the corresponding value of the positioning signal one can define for each point whether it refers to a product 2,3 or to the background element 5, regardless of the corresponding levels of signals A, A'. As previously explained and also illustrated in FIGS. 12*a-d*, this positioning signal C can be obtained starting from one or more observed light signals A, B whereby one can use this positioning signal C to indicate respectively, within this or other light signals, the position of the background 5 other products 2,3.

In a very advantageous embodiment the zones 50, 51 and 52 can be automatically calculated by means of known clustering algorithms, for example K-means.

The invention is not restricted to one and two-dimensional presentations, but can be easily extended to three and more dimensional presentations, be it by means of one, two or three-dimensional projections in those cases.

Hereafter a detailed description is given, as displayed in FIG. 8, of a possible practical construction of an apparatus 26 for the realization of the method mentioned above.

FIG. 8 displays a complete sorting apparatus 26 in viewing perspective. This apparatus consists of a supply system 1, more specifically a vibrating table transporting a stream of products 2,3 in a certain direction 27 through the sorting apparatus. During its free fall the product is additionally guided by a free-fall plate 4.

The structure 26 is furthermore equipped with 2 inspection devices 9, 10. These inspection devices 9, 10 inspect an inspection zone 28 by means of a concentrated light beam that sweeps across the entire width W of the product stream. In the absence of products a background element is scanned that, according to the invention, may hold the optical characteristics of the products to be rejected.

The products 3 to be rejected are blown out of the product stream via the air valves. The accepted products 2 are guided through a shaft 53 towards possible further production steps.

Figure 9A:
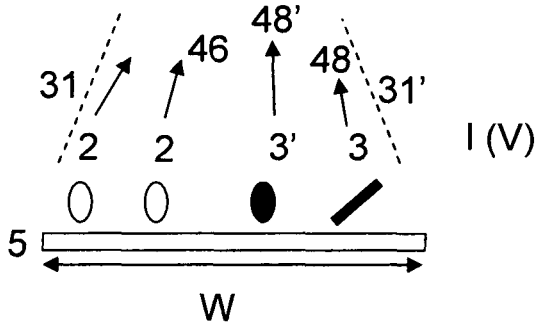
Figure 9B:
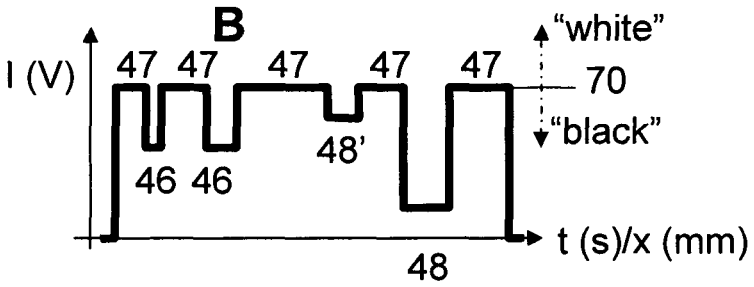
Figure 9C:
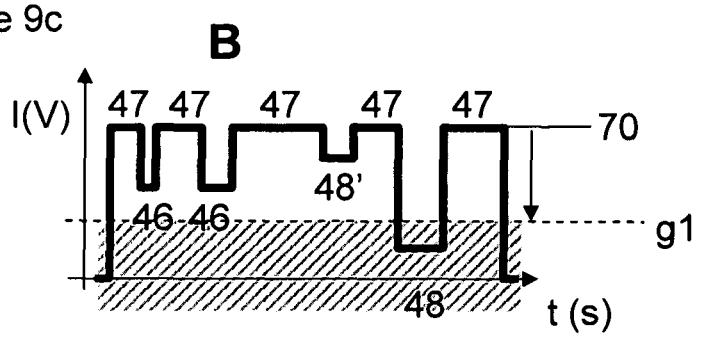

During linear scanning of the product stream and the background element 5 signals are detected originating from this background element 5 and the product stream, notably the good products 2 and bad products 3. By adjusting frequency and spatial filters one can generate control signals from the detected signals that enable to sort the supplied products according to previously stipulated criteria using the reject system 11. Depending on the chosen background element 5 the background signal 47 will have a higher or lower intensity value: a white background gives a higher value, a black background gives a lower value as indicated in FIG. 9*b*. Signals originating from good 46 and bad 48 products are superimposed on this background signal 47. Each product 2, 3, 3' gives a corresponding signal peak 46, 48, 48', each characterized by a certain pulse width and pulse height or signal level. FIG. 9*b* schematically reflects this combined signal B, obtained for a scan wherein two good 2 and two bad 3 products were scanned as in FIG. 9*a*. The desired products 2 are to be retained in the product stream, while the undesired products 3,3' are to be rejected by the reject system 11. When neither a good product 2 nor a bad product 3, 3' is scanned, the reject system 11 must remain inactive. Although at that time no single product to be rejected is present in the system, the unnecessary activation of the reject system 11 could cause an undesired disturbance of the product stream. The reference level 70 in this combined signal B is situated on the level of the background signal 47. In the current state of the art, based on this signal combination represented in FIG. 9*c*, one could identify the bad products 3 by determining a first "negative" threshold value g1. Those bad products 3 giving a signal peak 48 that exceeds the first threshold value g1 may be removed from the product stream. This threshold value is specified as being negative throughout this description, because it is situated below the reference level 70 in the reference system of FIG. 9*a-e*. As the background signal 47 constitutes the reference 70 for determining the signal peak 48 and the threshold value g1, the level of this signal peak 48 will always be situated past this first threshold value g1 as indicated by the hatched area in FIG. 9*c*. The good products 2 have a signal peak 46 that does not reach past the first threshold value g1. As long as the bad products 3 have a signal peak 48 that stays underneath the signal peaks 46 of the good products and past the first threshold value g1, one can distinguish the good products 2 from the bad products 3 based on these signals 46, 48, which ultimately allows sorting the products in a stream of good products 13 and a stream of bad products 12.

In some cases, however, it is possible that a bad product 3' generates a signal 48' from which the peak is smaller than the signal 46 originating from a good product 2. This issue has already been clarified in the embodiment illustrated by FIG. 6. The selection method presented in FIG. 9*c* does not allow distinguishing such bad products 3' from the product stream just like that. After all, when one shifts the negative threshold value g1 to the level of the reference value 70 of the background signal 47 in a manner that de signal peak of the bad product 3' reaches past the threshold value g1, the good products 2 will be removed as well. The corresponding signals 46 have, after all, a peak value that is bigger than the one of such bad products 3'.

Figure 9D:
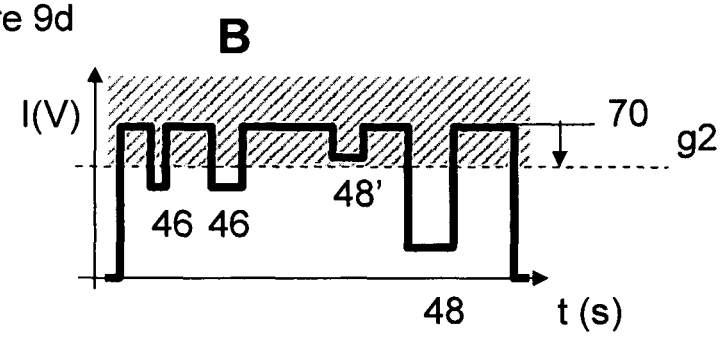

One could identify such bad products 3' by defining a second, negative threshold value g2. The second threshold value g2 is chosen in such a way that the signal peaks 46 of the good products 2 would reach past this second threshold value g2, whereas the signal peaks 48' of such bad products 3' would not reach past the second threshold value g2, as indicated by the hatched area in FIG. 9*d*. Signals that are situated below this threshold value g2 then match products 3' that are to be rejected from the product stream. Not only the signal peaks of the good products 2 but also the signal peaks 48 of the other, bad products 3 reach past the second threshold value g2 and past the first threshold value g1 as described above. A problem that can occur regarding the choice of the threshold value g2 in FIG. 9*d* is that all the signals, those of the good products 2 as well, pass partially underneath and partially above the threshold value g2 and could in this way be wrongly interpreted as originating from a bad product. This is also illustrated in FIG. 9*f*, in which the signal peaks from a product to be rejected 3' are situated within a strip limited by two threshold values g2 and g2', containing the signal peaks a product type to be rejected. Here also the signal peaks from the good products 2 will pass through such a strip and are possibly erroneously considered as originating from a product to be rejected 3'

Figure 9E:
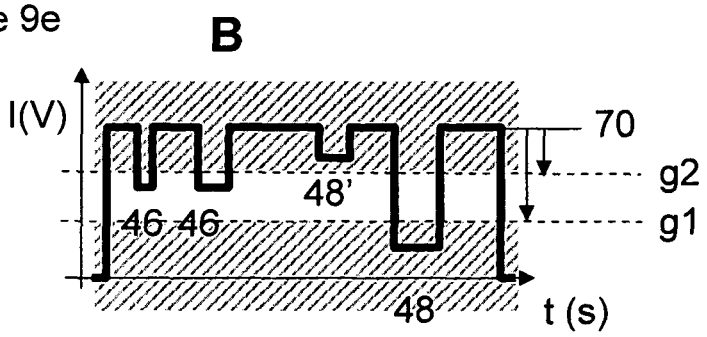
Figure 9F:
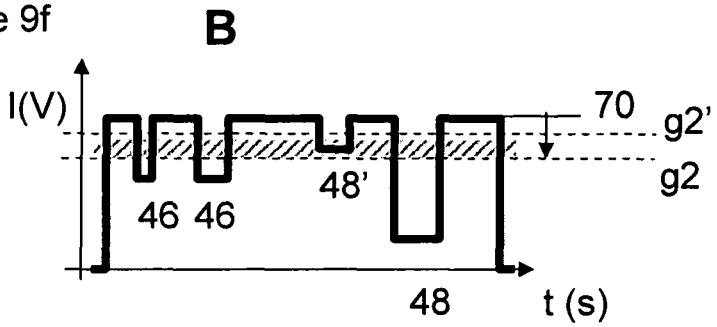

By a suitable choice of the threshold values g1 and g2, one can identify from the combined signal as indicated in FIG. 9*e*, bad products 3, 3', characterized respectively by a high signal peak 48 and a low signal peak 48'. Only the signals 46 within the strip constituted by both threshold values g1-g2 are considered as originating from a good product 2. One could also describe these threshold values as respectively an upper limit g1 and a lower limit g2, together limiting a signal strip locating the signal peaks to which the reject system 11 may not react.

The selection method in the current state of the art as presented in FIGS. 9*a-f* will, however, not work without error. Since the background signal 47 is to be used as a reference for determining the signal peaks 46,48,48' and the threshold values g1 and g2, this background signal 47 will always be situated above the second negative limit g2. Just like with the bad products 3' the reject system 11 will react on the presence of the background element 5. Consequently the reject system 11 will react to:

- product signals 48 with a signal peak passing the first negative threshold value g1;
- product signals 48' with a peak that does not reach past the second negative threshold value g2; and
- background signals 47 that by definition do not reach past the second, negative threshold value g2.

The good products are indeed situated in the strip between a first, negative threshold value g1 and a second, negative threshold value g2. One could sort the good products using this procedure by well selecting the values. The problem with the background however is not resolved: this is, as illustrated by FIG. 9*a-e*, considered to be a bad product.

In the current state of the art this problem is solved by physically constructing the background element 5 in such a way that it provides a signal 47 that is comparable, for the detected optical parameter, to the signal 46 originating from a good product 2 and is thus situated within the strip constituted by both threshold values g1, g2. As mentioned above, it is, however, difficult to construct a background element 5 in such a way that, for the measured optical parameter(s), it not only resembles the actual good product 2 sufficiently well, but that it can retain this resemblance of a specific product 2 to a sufficient extent and over a considerable time. Furthermore the problem remains that one has to install for each product 2 a matching background element 5.

Figure 10A:
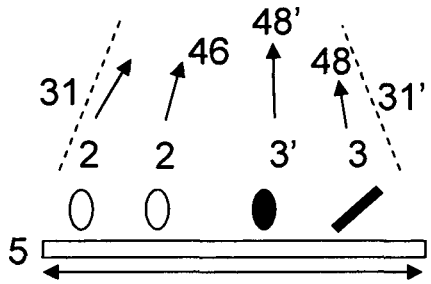
Figure 10B:
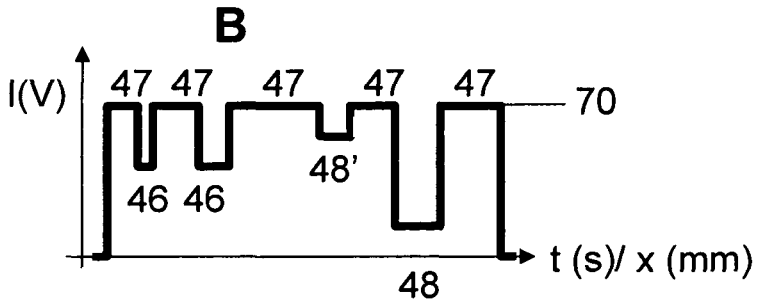
Figure 10C:
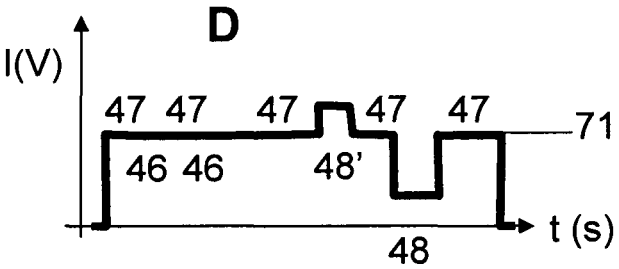

In the different embodiments of the invention the reference level 70 of the combined signal B is shifted using signal processing techniques to a new value 71 that preferably matches the signal level 46 of a good product 2. The signal peaks 48, 48' of the bad products 3,3' are being referenced in the processed signal D to the new reference level 71. To clarify the invention this new reference 71 is adjusted to the signal level 46 of a good product 2. This is illustrated in FIG. 10*c*. Where originally the reference level 70 was situated on the background signal 47, as is indicated for signal B in FIG. 10*b*, the reference level 71 for the new signal D is substantially equal to the signal level 46 of the good products 2. Through this shift in reference level 71->71, resulting from signal processing, the matching signal peaks 48 for some bad products 3 will still stretch out from the new reference level 71 downwards. These are the undesired products 3 that had, in the original reference framework of the signal B as illustrated in FIG. 10*b*, a signal peak 48 that stuck out past this one 46 of the desired products 2. These undesired products 3 still give rise to a negative signal peak even in the new reference framework 71 of the signal D. For any other undesired products 3', the corresponding signal peaks 48' will now stretch out from the new reference level 71 upwards. These are the undesired products that in the original reference framework 70 illustrated in FIG. 10*b*, had a signal peak 48' that did not stick out past this 46 of the desired products 2. Instead of providing a negative signal peak, these undesired products 3' provide a positive signal peak 48' in the new reference framework 71. By shifting the level 71 with respect to whatever the different product signals were being referred to, it is now as if the given background signal 47 with level 70 is removed from the detected signal B and replaced by a new signal with level 71 in the signal D. By this replacement of the reference level 71 a new signal D is obtained, as indicated in FIG. 10*c*, now containing information about the products 2, 3, 3' in such a manner that these products can be distinguished from each other without the problems present in the state of the art.

Figure 10D:
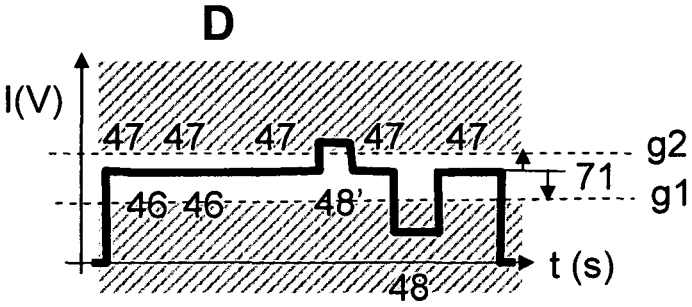

Now one can identify the good products 2 by defining an appropriate threshold value(s) for the new signal D, as demonstrated in FIG. 10*d*, while one must distinguish between 2 types of bad products 3,3'. As for the product signals 46, 48, 48' these threshold values are referred to the new reference level 71, which, in this example, has been chosen such that it is substantially equal to the signal level 46 of the good products 2. A first, negative threshold value g1 has been chosen in such a manner that the undesired products 3, provide a signal peak 48 till past this first threshold value g1. These products 3 may be rejected from the product stream by activating the reject system 11. A second, now positive threshold value g2 is chosen in such a manner that the undesired products 3' provide a signal peak 48' past the second threshold value g2. This threshold value is indicated as positive because in the given reference framework this threshold value g2 is situated above the reference level 71. These products 3' may be rejected from the product stream by activating the reject system 11. As the signal level 70 of the background signal 47 according to the background element 5 is shifted to the new reference level 71, in this case matching the signal from the good products 2, the variations on the signal level of the background signal 47 will be situated within both threshold values g1, g2. Therefore the reject system is not activated.

The signal levels 46 of the good products 2 may show small variations, provided that these variations are situated around the reference level 71 within both threshold values g1, g2. The reject system is not activated in that case.

By appropriately choosing the threshold values g1 and g2, one can identify from a combined signal as indicated in FIG. 10*d*, bad products 3,3' characterized by respectively a high signal peak 48 and a low signal peak 48'. All signals 48, 48' outside the strip defined by both threshold values g1-g2 compared to the reference level 71 are considered as originating from a bad product 3, 3'. Although in the embodiment illustrated by FIGS. 10*a-d* a signal is shown with 2 types of bad products 3,3' the invention is not limited to such signals. Also in signals B whereby only one bad product type, either 3, or 3' occurs, one can apply the signal processing technique as illustrated in the different embodiments of the invention. This is illustrated by FIGS. 15*a-c* and FIG. 6, in which only one undesired product of the type 3' occurs, namely with a signal peak 48' compared to the original reference level 70 that is smaller than the signal peak 46 of the good product 2. By shifting the reference level 71 one can unmistakably distinguish this signal peak 48' from the signal peak 46 without the problems of the present state of the art, such as the undesired reaction of the reject system 11 on a background signal 47 or on a signal peak 46 that would reach past the lower limit g2 when one would continue to use the original reference framework 70 for further signal processing.

By shifting the reference level 70 to a suitable new value 71 one can better distinguish between the different products 2, 3 and/or 3' and avoid the unnecessary activation of the reject system 11 either when detecting the background signal 47 and/or when a lower limit g2 is passed by a signal 46.

Because one shifts the reference level 70 of the background 47 to a new level 71 in the embodiments according to the invention using signal processing techniques, one picks a background signal 47 that differs, preferably considerably, from any product signal 46, 48, 48'. As one shifts the background reference level 47 via signal processing, preferably to the signal level 46 of a good product 2, the accurate value of this background level 47 is not important, as long as the background element 5 provides a signal 47 that differs, preferably considerably, from the signals 46, 48, 48' of any product 2, 3, 3'. This choice of background signal 47 enables to clearly distinguish between the original reference level 70 and the product signals 46, 48, 48' and, as such, refer these product signals to the new level 71.

In the state of the art, there are different ways to determine the level 70 of this background signal 47. One can allow the inspection configuration(s) 9,10 to work without supplying any products. The selected signal B will substantially match the signal 47 of the background element 5. One can also insert known products 2, 3, and/or 3' at known positions in the scanning beam of the inspection unit 10. The immediate signal being detected, i.e. on the given moment t(s), matches a given immediate position of the scanning beam of light and thus with a given position x(mm) in the product stream. In this way one can identify and correlate the different signals 47, 46, 48 and/or 48' in the signal B with the background element 5 and with the transported products 2, 3 and/or 3'. Instead of the above static tuning procedure, one can also proceed in a more flexible way. As illustrated in FIG. 1, a sorting system can operate in which the product stream is scanned and signals B are detected. Initially, all products are either accepted or rejected. By gradually adjusting the threshold values g1 and/or g2 a selection within the product stream will be made. One can continue adjusting the threshold values until clearly only the undesired products 3, 3' are rejected. FIG. 7 illustrates such a dynamic specification of the different signal levels and the corresponding adjustment of the threshold value(s).

As indicated in the previous paragraphs, the invention aims at redefining 71 the reference level 70 of the detected signal B via signal processing in such a way that a new signal D is obtained that permits the products 2, 3 and/or 3' to be distinguished from each other without the problems present in the state of the art. Preferably the signal 46 coming from the good products 2 and the signal 47 coming from the background element 5 will be shifted to a substantially equal signal level 71, at least for the detected optical parameter.

In order to determine which zone of the signal B corresponds to the background signal 47 and, therefore, in which zone one should replace the signal level 70 by a new suitable reference level 71 for the product signals 46,48 and 48', one can determine in the original signal B which zones 46,48 and 48' indicate the presence of the products 2, 3, 3' in the line scan and which zones 47 indicate the absence of a product or, in other words, the presence of the background element 5 in the line scan.

There are different embodiments to obtain a signal C based on one or more detected signals, of which the pulses are indicative of the location of a product 2, 3, 3'. This location signal C thus contains information about both the desired products 2 and the undesired products 3, 3'.

FIGS. 11*a-d* illustrate a first embodiment. In the detected signal B one can distinguish zones corresponding to the background signal 47 from the zones corresponding to product signals 46, 48 and 48'. As stipulated above, because the signal 47 originating from the background element 5 is chosen in such a way that it differs from the signals 46, 48 and 48' of the products 2, 3, 3', one can define one or more threshold values g3 and g4 in the signal B, such that the signal levels 46, 48 and 48' from the products 2, 3, 3' are located outside these threshold values, e.g. on one side of this threshold value g3 and the signal level 47 of the background element 5 is located within these threshold values, e.g. on the other side of this threshold value g3. FIG. 6 illustrates the embodiment wherein one has determined two threshold values g3/tmin and g4/tmax containing the background signal 47. FIG. 11*b* illustrates an embodiment wherein one uses merely one threshold value g3 to define the background signal 47 against the product signals 46, 48 and 48'. In this signal analysis the signal peaks 46, 48 and 48' and the threshold value g3 are determined with respect to the original level 70 from the background signal 47. Each peak 46, 48, 48' that stretches past this threshold value g3 thus indicates a presence of a product 2, 3, 3'. One obtains a signal C having a pulse each time a product 2, 3, 3' is detected in the line scan. In FIG. 11*c* such a signal C is shown, whereby the product pulses 46, 48 and 48' are already inverted compared to the original signal B. This signal C can also be a binary signal as shown in FIG. 11*d*. By converting the analogue signal into a digital signal one obtains a pulse train C of "1" and "0" pulses, whereby "1" indicates the presence of a product 2, 3, 3' and "0" indicates the absence of a product 2, 3, 3'.

In this embodiment the same detected signal B is first used to generate a product location signal C, after that, as shown above, this detected signal B is combined with the signal C to shift the reference level as illustrated in FIG. 10*a-d*.

FIGS. 12*a-d* give a schematic representation of different embodiments of this signal processing process. In the embodiment illustrated in FIG. 12*a* the detected signal B and threshold value g3 are compared in a signal processing unit 60 to generate the product location signal. This signal C is then combined in a signal processing unit 61 with the detected signal B in order to determine which zones of this detected signal B match the signal 47 originating from the background element 5. The reference level 70 of these background signals is then shifted to the desired level 71, preferably the level 46 of the good products 2, which thus generates a signal D with an adjusted reference level 71 that allows distinguishing signal peaks of the good products 2 from these of the undesired products 3, 3' in the product stream. Due to the choice of the threshold values g1 and g2 one can distinguish between the signals 48, 48' of the undesired elements in the product stream and the signals of the desired elements 2.

As discussed in the previous sections it is not required for the signals C and B to originate from the same detected signals B. FIG. 12*b* illustrates a signal processing process in which a signal C is obtained based on a first signal B. This signal C is then being used for determining the position of the signal peaks 46, 48, 48' within the second signal B'. The location signal C is obtained based on one or more first detected signals B after which this location signal C is being used to indicate the position of the products in one or more detected second signals B'. Both signals B, B' are detected during the same line scan because the light returning from the product stream is converted via suitable spatial and/or frequency filters into the distinct signals B, B'. As these signals are immediately correlated with each other, as mentioned earlier, one can combine them or apply information from one signal to another signal. In such a way one can use the product location obtained based on the first signal B, to indicate in another signal B' where the zones 16, 17 originating from the products 2, 3, 3' and the zones 15 from the background element 5 are located.

As illustrated in FIGS. 12*c* and 12*d* the product location signal C can also originate from different signals Bi. By scanning the product stream in different ways, for instance with beams of light 45 that have different frequencies, or by analyzing the light that returns from the product stream in different ways, for instance by suitable spatial and/or frequency filters, one can obtain a more complete image of the product stream and avoid that a product remains unnoticed. First, one can combine these signals Bi in a signal processing unit 62 and transform 60 the combined signal B in a signal C as illustrated in FIG. 12*c*. The signal processing unit 62 shall be able to combine these detected signals Bi in any possible manner: addition, subtraction, multiplication, . . . as shown in FIG. 12*c*. One can also first convert the different signals Bi into corresponding product location signals Ci, which are subsequently combined in a signal processing unit 62 into the desired product location signal C, as shown in FIG. 12*d*. Here the signal processing unit 62 will combine the different independent positioning signals Ci via an "OR" function so that no product location information is lost.

FIGS. 13*a-c* illustrate another embodiment to obtain the product location signal C. In the embodiment illustrated by FIGS. 11*a-d*, a signal 47 is generated during scanning by the background element 5. This background signal can be a result of reflections of the incident optical signal 34, or by fluorescence of this background element 5 due to this exposure. The background signal 47' was captured in this embodiment together with the signals 46, 48, 48' originating from the products 2, 3, 3'. This line-up is also illustrated in FIG. 2. In the embodiment of FIG. 13*a-c* however, the background element 5 will not reemit any signal, but will only detect the immediate incidence of light on this background element 5. The light 45 generated by the light source 29, is being blocked by the products 2, 3, 3' that are located between the background element 5 and the light bundle 45. As illustrated in FIG. 13*a* and FIG. 2, when the products are scanned, they will emit a light signal 46, 48, 48', for example by reflection or by fluorescence. Only the light 34 that was not blocked by these products 2, 3, 3' will strike at the posteriorly positioned background element 5. When the background element 5 is provided with elements 57, 40 that allow capturing and detecting the incoming light 34, a signal C is obtained, that is indicative for the presence of products 2, 3, 3' in the product stream for a given position of the scanning light bundle, or in other words, on a specific moment t(s) or yet in other words, for a specific position x(mm) according to the line scan. After all, the position of the light bundle 45 during the scan of the product stream is known, and it will therefore be no problem to correlate the time path of the signal 47', captured by the background element 5, with the time path of the signals 46, 48, 48', originating from the products 2, 3, 3' and thus with the position x (mm) of a product 2, 3, 3' in the product stream. FIG. 13*c* illustrates the obtained signal C', this time only showing peaks where there is no product 2, 3, 3' present in the scanned product stream. In FIG. 13*c*, these peaks are labeled by background reference 5, namely the incidence of the light bundle 34 on the background element 5. This analogue signal C' can also be transformed into a digital signal, thus a pulse train C of "1" and "0" signals is obtained, wherein "1" indicates the absence of a product 2, 3, 3' and "0" indicates the presence of a product 2, 3, 3'. The person skilled in the art will understand that this digital signal C', if desired, can easily be transformed, using signal processing techniques, into a pulse train C, where "1" indicates the presence of a product 2, 3, 3' and the "0" indicates the absence of a product 2, 3, 3', so that a signal as depicted in FIG. 11*d* is obtained.

An advantage of the embodiment illustrated by FIGS. 13 *a-c* en FIGS. 3*a* and 3*b*, is that the background element 5 can be placed at a larger distance d from the product stream. This prevents the background element 5 from being polluted by the product stream. In this set up, the only essential issue is whether or not, for every immediate position of the moving light bundle, a signal on the background element 5 is obtained. Because one uses a concentrated light bundle 45, such as a laser beam, the light will not substantially diverge once it has passed the product stream, even if the background element 5 is not being placed in direct proximity of the scanned product stream. Consequently, the solid angle at which the concentrated light bundle 34, for an immediate position of the scanning light beam 45, strikes the background element 5 is small enough to enable distinguishing, with sufficient accuracy, between the different positions of the moving light bundle in the scan line.

FIG. 14 gives a schematic presentation of this signal processing process, starting from the signal obtained as illustrated in FIGS. 13*a-c*. The product location signal C, originating from the background element 5, is being combined 61 with the detected signal B so as to determine which zones of this detected signal B correspond to a signal 47, coming from the background element 5. The level 70 of these background signals is shifted to the desired level 71, preferably the level 46 of the good products 2, thus generating a signal D with an adjusted reference level that allows distinguishing between the signal peaks of the good products 2 and those of the undesired elements 3, 3' in the product stream. According to the choice of the threshold values g1 and g2, the signals 48,48' of the undesired elements in the product stream can be distinguished from the signals of the desired elements 2, as illustrated in FIGS. 10*c-d*.

FIGS. 3*a* and 3*b* illustrate different embodiments of such a background element 5 that is capable of detecting uninterrupted light beams 34.

As illustrated in FIGS. 12*a-d*, 14, the processing unit 41 comprises, according to the different embodiments, means 60, 62 for generating a location signal C based on one or more detected and converted signals B. Furthermore, this processing unit 41 comprises means 61 for genrerating, based on this location signal C, a signal D based on the same or other one or more detected and converted signals B, whereby the background level (70) of these latter signals is shifted to a new level (71) that allows for a clearer and more efficient distinction between the good products (2) from the bad products (3) in this signal D.

The invention claimed is:

1. A method for sorting a product stream into products to be accepted and products to be rejected comprising:

moving the product stream through a scanning zone, with the product stream extending over a predetermined width W and having a thickness of substantially a single layer of products;

linearly scanning across the width W of the product stream in the scanning zone with one or more concentrated light beams to illuminate the product stream and a background element positioned behind the product stream and extending over the width W, whereby the one or more concentrated light beams produce reflected light signals from scanned products and reflected light signals from the scanned background element, and wherein the background element is chosen such that the corresponding detected reflected light signal from the scanned background element differs in at least one parameter from the reflected light signals from both the scanned products to be accepted and the scanned products to be rejected;

detecting the reflected light signals and converting the reflected light signals into electric signals;

after detecting and converting the reflected light signals into electric signals, shifting a background level of the electric signals, wherein the background level is obtained from converting reflected light signals from the background element, to a new background level, to obtain a signal D, wherein said new background level is chosen such that an electrical signal level of the signal D corresponding to a scanned product to be accepted differs from an electrical signal level of the signal D corresponding to a scanned product to be rejected, and wherein the new background level is not identified as a product to be rejected;

after shifting the background level of the electric signals, generating one or more control signals based on the electric signals whereby the control signals allow making a selection between the scanned products to be accepted and the scanned products to be rejected; and sorting the product stream using the one or more control signals.

2. The method according to claim 1, wherein after shifting the background level of the electric signals, the thus obtained signal D is compared to one or more threshold values to generate the one or more control signals.

3. The method according to claim 2, wherein moving the background level further comprises:

generating a signal C which is indicative of a location of scanned products in the electric signals, and shifting the level of the electric signals at locations other than locations of the scanned products as indicated by location signal C.

4. The method according to claim 3, wherein generating the location signal C further comprises:

detecting and converting the light signals originating from the scanned background element and from the scanned products, and in these converted signals, separating the signal originating from the scanned background element from the signals originating from the scanned products to obtain a signal C indicative of the location of the scanned products.

5. The method according to claim 4, wherein distinguishing the signal originating from the scanned background element further comprises comparing the converted signals to one or more additional threshold values.

6. The method according to claim 4, wherein the background element consists of a surface that extends over the width W of the product stream, wherein said surface at least partially reflects incident light.

7. The method according to claim 6, wherein the background element has the shape of a cylindrical roller.

8. The method according to claim 3, wherein generating the location signal C further comprises detecting and converting the position of the concentrated scanning light beam as it is passed by the scanned products to obtain a signal that is indicative of the location of the scanned products.

9. The method according to claim 8, wherein the background element consists of means to capture incident light and redirect it towards an opto-electrical convertor.

10. The method according to claim 9, wherein the background element comprises an optical fiber with a grooved surface for capturing incoming light.

11. The method according to claim 10, wherein the optical fiber consists of segments and wherein for each segment an orientation of the grooves with respect to a longitudinal direction of the optical fiber is chosen as a function of a position of the segment along the width W of the product stream.

12. The method according to claim 3 wherein the location signal C is a Boolean signal.

13. The method according to claim 12, wherein shifting the signal level to obtain signal D comprises the formula: $D = BC + s(C \oplus 1)$, wherein B is the electric signals, s is a real number chosen as a function of the desired shift of the signal level, C is the location signal, and $\oplus$ is defined as the modulo-2 addition.

14. The method according to claim 12, wherein shifting the signal level to obtain signal D comprises the following formula:

$$D = B \text{ when } C = 1$$

$$D = 0 \text{ when } C = 0$$

wherein B is the electric signals, and C is the location signal C.

15. The method according to claim 12, wherein comparing signal D to one or more threshold values only occurs at locations of the scanned products as indicated by the location signal C.

16. The method according to claim 3, wherein the location signal C is generated on the basis of one or more first electric signals B and wherein the location signal C is used for indicating the location of the scanned products in one or more second electric signals B'.

17. The method according to claim 1, wherein the background level of the electric signals is shifted towards a new signal level corresponding to that of a scanned product to be accepted.

18. The method according to claim 1, wherein the signal D is priorly filtered such that high-frequency transitions near product zones are flattened to generate a new filtered signal E.

19. The method according to claim 18, wherein the filtering is achieved by means of an adaptive filter which is specifically tuned to flatten transitions going from a product zone to a background zone and vice versa.

20. The method according to claim 1, wherein the linear scanning of the product stream comprises scanning by a rapidly rotating polygonal mirror.

21. The method according to claim 1, wherein the concentrated light beam comprises a laser beam.

22. The method according to claim 21, wherein the linear scanning of the product stream comprises scanning by several concentrated light beams with each light beam having a separate frequency.

23. The method according to claim 1, wherein supply of the product stream is provided by means selected from the group consisting of a vibrating table and a conveyor belt.

24. The method according to claim 23, wherein the product stream is further supplied via a free-fall plate which guides the products during free fall towards the scanning zone.

25. The method according to claim 1, wherein sorting the product stream by means of the one or more control signals comprises controlling a manifold of air valves positioned across the width W of the product stream.

26. The method according to claim 1, further comprising starting the linear scanning from both edges of the product stream.

27. The method according to claim 1, wherein sorting the product stream by means of these one or more control signals further comprises sorting based on color.

28. The method according to claim 1, wherein generating one or more control signals by means of shifting the background level of the converted signals to a new signal level is chosen such that, in the thus obtained signal D, the signal level of a signal of a scanned product to be accepted distinguishes itself from the signal level of a signal of a scanned product to be rejected, further comprising:

combining two electric signals A, A' in a two dimensional graph, wherein each point in that graph corresponds to a particular intensity level according to a path of the first signal combined with a particular intensity level according to a path of the second signal;

points which correspond with product to be accepted are grouped in a first zone;

points corresponding to product to be rejected are grouped in a second zone;

points corresponding to the background element are outlined by a third zone; and shifting the level of the background signal is effectively achieved by moving the third zone to a new location n, n'.

29. The method according to claim 28, wherein moving the third zone comprises visualizing the third zone in a graph displayed in a graphical user interface and subsequently dragging the third zone to a new location.

30. The method according to claim 28, wherein the new location n, n' is chosen such that a separation can be made by means of a separation plane g' between the first and third zone (50') on one hand and the second zone on another hand.

31. The method according to a claim 28 wherein the two dimensional graph has an additional dimension showing a histogram of said signal combinations.

32. The method according to claim 28, wherein more than two signals are combined with each other in a multi-dimensional graph.

33. The method according to claims 28, wherein at least one of said first, second and third zones can be determined by means of automatic clustering algorithms.

34. An apparatus for sorting products into products to be accepted and products to be rejected, comprising:

means for transporting the products to be sorted in the form of a product stream extending over a width W comprising a single layer of products;

means for scanning the products to be sorted across the width of the product stream, wherein these scanning means further comprise:

means for generating a concentrated light beam and directing the light beam towards the products to be sorted via optical means;

means for detecting reflected light and converting the reflected light into an electric signal;

selection means comprising means for generating control signals enabling a selection between the scanned products to be sorted based on the detected light; and means for sorting the product stream as a function of said one or more control signals, wherein the sorting apparatus further comprises:

a background element chosen such that a corresponding detected reflected light signal from the scanned background element differs in at least 1 parameter from the reflected light signals of both the scanned products to be accepted and the scanned products to be rejected; and wherein the means for generating one or more control signals further comprises means for shifting a background level of the electric signals, wherein the background level is obtained from converting reflected light signals from the background element, to a new background level, to obtain a signal D, wherein said new background level is chosen such that an electrical signal level of the signal D corresponding to a scanned product to be accepted differs from an electrical signal level of the signal D corresponding to a scanned product to be rejected, and wherein the new background level is not identified as a product to be rejected.

35. The sorting apparatus according to claim 34, wherein the selection means further comprise:

means for generating a location signal C based on one or more electric signals, means for obtaining a signal D based on this location signal C and based on these or other one or more captured signals B, shifting the background level in these last signals to a new level, which allows distinguishing between products to be accepted and products to be rejected in said obtained signal D.

36. The sorting apparatus according to claim 34, wherein the selection means further comprise means for comparing the obtained signal D to one or more threshold values to generate the one or more control signals.

37. The sorting apparatus according to claim 34, wherein the selection means further comprise means for filtering the signal D so that the high-frequency transitions near product zones are flattened to create a new filtered signal E.

38. The sorting apparatus according to claim 37, wherein the means for filtering further comprises an adaptive filter specifically tuned for flattening transitions from a product zone to a background zone and vice versa.

39. The sorting apparatus according to claim 34, wherein the background element comprises a surface that extends over the width W of the product stream, said surface reflecting incident light at least partially.

40. The sorting apparatus according to claim 39, wherein this background element comprises a cylindrical roller.

41. The sorting apparatus according to claim 34, wherein the background element comprises means for capturing incident light and redirecting it towards an opto-electrical convertor.

42. The sorting apparatus according to claim 41, wherein the background element comprises an optical fiber with a grooved surface for capturing incoming light.

43. The sorting apparatus according to claim 42, wherein the optical fiber consists of segments and wherein, for each segment, an orientation of the grooves with respect to a longitudinal direction of the optical fiber is chosen as a function of a location of the segment along the width W of the product stream.

44. The sorting apparatus according to claim 34, wherein the means for generating the concentrated light beam comprises a laser.

45. The sorting apparatus according to claim 44, wherein the means to direct the concentrated light beam towards the products comprises a rotating polygonal mirror for moving the concentrated light over the width W of the product stream.

46. The sorting apparatus according to claim 34, wherein the selection further comprises a signal processing platform based on digital electronic components selected from the group consisting of Field Programmable Gate Arrays, micro processors, analogue electronic circuits, op-amp circuits, and combinations of analogue and digital processing units.

47. The sorting apparatus according to claim 34, wherein the means for sorting the product stream comprises a manifold of air valves positioned transversely across the product stream.

48. The sorting apparatus according to claim 34, wherein the means to detect returning light comprises a detector device with an optical filter rendering the detector device sensitive to a particular light spectrum; in operational communication with a spatial filter rendering the detector device sensitive to a particular area of the returning light, and an opto-electrical convertor in operational communication with both said filters converting the light into a corresponding electric signal.

* * * * *